United States Patent [19]

Watanabe

[11] Patent Number: 4,720,750

[45] Date of Patent: Jan. 19, 1988

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 12,441

[22] Filed: Feb. 9, 1987

[30] Foreign Application Priority Data

Feb. 28, 1986 [JP] Japan ..... 61-42939
Feb. 28, 1986 [JP] Japan ..... 61-42948
Feb. 28, 1986 [JP] Japan ..... 61-42949

[51] Int. Cl.[4] ..... G03G 15/052

[52] U.S. Cl. ..... 358/300; 355/7; 355/14 R; 355/4

[58] Field of Search ..... 355/7, 8, 14 R, 3 R, 355/4; 358/285, 287, 300

[56] References Cited

U.S. PATENT DOCUMENTS 4,322,157 3/1982 Miura et al. ..... 355/7 X
4,417,805 11/1983 Kishi ..... 355/7 X
4,505,576 3/1985 Sugiura et al. ..... 355/7 X
4,631,599 12/1986 Cawkell ..... 355/7 X
4,655,577 4/1987 Ikuta ..... 355/14 R
4,666,288 5/1987 Watanabe ..... 355/7 X
4,667,248 5/1987 Kanno ..... 358/287
4,679,927 7/1987 Sogo et al. ..... 355/7 X

*Primary Examiner*—R. L. Moses
*Attorney, Agent, or Firm*—Oblon, Fisher, Spivak, McClelland & Maier

[57] ABSTRACT

An image forming apparatus comprising an original table for holding an original document and an area designation sheet, the area designation sheet to be read a surrounded area written thereon to designate a copy required area of the original document, a scanner for optically scanning the area designation sheet placed on the original table to obtain a light image of the surrounded area therefrom, a optical reading unit for generating electrical signals in response to the light image of the surrounded area corresponding to the required copy area designated on the area designation sheet, a memory for storing the electrical signals generated by the optical reading unit, a charge erasing unit for erasing selected portions of the electrostatic charge on the image carrier, and a controller for controlling the charge erasing unit to erase the electrostatic charge on the image carrier than in the copy required area to be copied, according to the electrical signals read from the memory.

13 Claims, 42 Drawing Figures

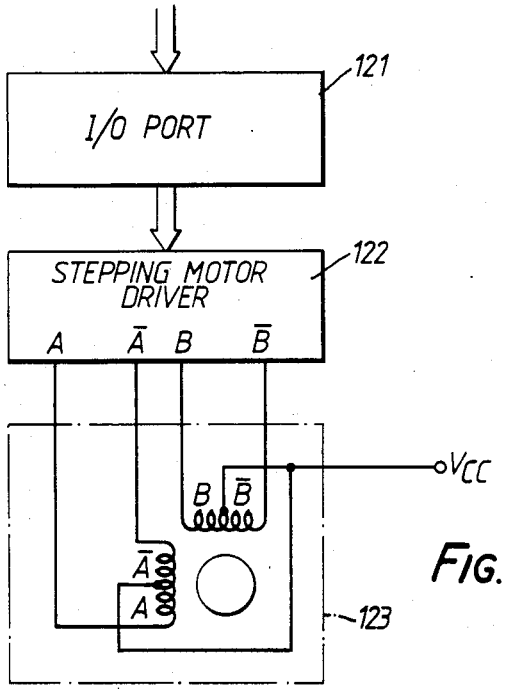
FIG. 11.
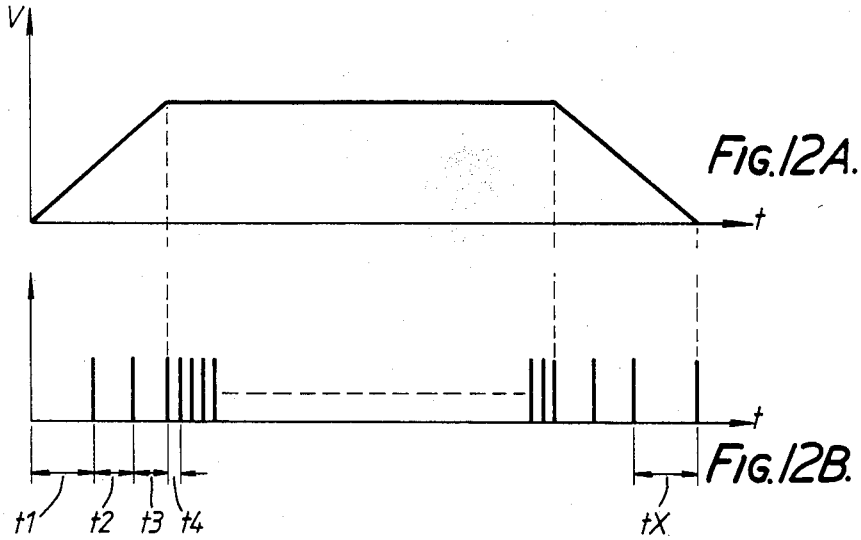
FIG. 12A.
FIG. 12B.

IMAGE FORMING APPARATUS

BACKGROUND OF THE INVENTION

1. Field of the Invention

The present invention relates in general to an image forming apparatus. More specifically, the invention relates to an electronic copying machine which is capable of designating any part of the original document image and erasing that part by comparatively simple construction and operation.

2. Description of the Related Art

A demand has arisen recently for the development of an image forming apparatus with a facility for editing the document image original which it copies. In particular, there is a strong demand for the development of a facility for omitting on the copy the unwanted part of a document image original.

One image forming apparatus has already developed which fulfils this requirement (U.S. Pat. No. 4,215,929, Sato et al.). This existing image forming apparatus consists of a light source which applies an image area control light which controls the formation of the electrostatic latent image on a photosensitive body by cutting off or applying light in association with the exposure of the document image original, a mask member which controls the said control light to a desired width by superposition, and a control means for controlling the working of this mask member. The aim here is to control the formation of the electrostatic latent image by the difference between the two operations, whereby the control light mentioned above is either transmitted or masked, and thus to obtain an image of the required area of the document image original. Depending on the way in which the mask member is superposed, either an image of a part of the document image original can be obtained, or the part can be erased and an image obtained of the remainder.

Further, this existing image forming apparatus is provided with a monitoring means which displays the document image original, and a position determining means, which in association with this monitoring means selects as desired that area of the document image orignal which is required. By controlling the mask member in association with the position determining means, the required area of the document image original can be selected at will as the document image original is displayed, and an image of that area obtained.

However, the existing image forming apparatus as disclosed in U.S. Pat. No. 4,215,929 has the following drawbacks.

(1) Mechanical parts, such as a motor and gears, are required to shift the mask member between the single and the superposed state, and this makes the apparatus complicated. Also, there is a strong possibility that in use over a long period the mask member will become deformed, making accurate masking impossible.

(2) The monitoring means consists of a lamp for irradiating the document, a mirror and lens for directing the light reflected from the document, and a screen on which the image of the document is projected. This monitoring means is provided separate from the document table which is provided, above the photosensitive body, for the exposure of the document. Space is therefore required for the provision of this monitoring means, and this increases the overall size of the image forming apparatus.

SUMMARY OF THE INVENTION

It is an object of the present invention to provide an improved image forming apparatus which is capable of designating any part of the original document image and erasing that part by comparatively simple construction and operation.

It is another object of the present invention to provide an improved image forming apparatus which is capable of designating any part of the original document image by a different color, and freely erasing the part corresponding to that color or changing the color of that part by comparatively simple construction and operation.

According to one aspect of the present invention, there is provided an image forming apparatus, wherein an electrostatic latent image is formed on an image carrier by a process of electrostatic charge and image exposure and a reproduced image is formed on the image carrier corresponding to the electrostatic latent image, comprising:

original holding means for holding an original document and an area designation sheet, the area designation sheet including means for defining a surrounded area to designate a copy required area of the original document;

scanning means for optically scanning the area designation sheet placed on the original holding means to obtain a light image of the surrounded area therefrom;

optical reading means for generating electrical signals in response to the light image of the surrounded area corresponding to the required copy area designated on the area designation sheet;

memory means for storing the electrical signals generated by the optical reading means;

charge erasing means for erasing selected portions of the electrostatic charge on the image carrier; and controlling means for controlling the charge erasing means to erase the electrostatic charge on the image carrier than in the copy required area to be copied, according to the electrical signals read from the memory means.

BRIEF DESCRIPTION OF THE DRAWINGS

These and other objects and advantages of this invention will become more apparent and more readily appreciated from the following detained description of the presently preferred exemplary embodiments, taken in conjuntion with the accompanying drawings of which:

FIGS. 1–23 show a first embodiment of an image forming apparatus according to the present invention, in which:

FIGS. 1 and 2 are schematic perspective view and a side sectional view, respectively, showing the construction of the images forming apparatus;

FIG. 3 is a plan view of the layout of the control panel;

FIG. 4 is an oblique view of the construction of the drive unit;

FIG. 5 is an oblique view showing in outline the drive mechanism of the optical system;

FIG. 6 is an oblique view showing in outline the drive mechanism of the pointers;

FIG. 7 is a block diagram showing the overall control circuit;

FIG. 8 is a block diagram of the main processor group;

FIG. 9 is a block diagram of the first sub-processor group;

FIG. 10 is a block diagram of the second sub-processor group;

FIG. 11 is an outline block diagram of the stepping motor control circuit;

FIGS. 12A and 12B explain how the speed of the pulse motors is controlled;

FIG. 13 is a lateral section showing the positioning of the erasure array;

FIG. 14 is a lateral section of an essential part showing an example of a different positioning of the erasure array;

FIGS. 15 and 16 are perspectively view and a front view, respectively, of only the principal part of the erasure array, showing the relationship between the erasure array and a photosensitive drum;

FIG. 18 is a circuit diagram showing the layout of the array drive unit;

FIG. 20 show the relation between the working of the reading section and the area designation sheet placed on the original table;

FIGS. 21A–21C show the relationship between the original document, area designation sheet and copied paper, in which:

FIG. 21A is an example of an original document on which something is written;

FIG. 21B is an example of an area designation sheet on which a surrounded area is written;

FIG. 21C is an example of copy on paper;

FIG. 22 is a plan view showing the position in which the original document is placed on the original table;

FIG. 23 is a flow chart explaining the steps in the working of the apparatus;

FIGS. 24–27 show a second embodiment of an image forming apparatus according to the present invention, in which:

FIG. 24 is a block diagram showing the overall control circuit;

FIGS. 25A–25D show the relationship between the original document, area designation sheet and copied paper, in which:

FIG. 25A is an example of an original document on which something is written;

FIG. 25B is an example of an area designation sheet on which a surrounded are is written;

FIGS. 25C and 25D are examples of copy on paper;

FIG. 26 show the relation between the working of the reading section and the area designation sheet placed on the original table;

FIG. 27 is a flow chart explaining the steps in the working of the apparatus;

FIGS. 28–32 show a third embodiment of an image forming apparatus according to the present invention, in which:

FIGS. 28 and 29 are schematic perspective view and a side sectional view, respectively, showing the construction of the images forming apparatus;

FIG. 30 is a side sectional view showing the construction of an automatic document feeder;

FIGS. 31A–31C show the relationship between the original document, area designation sheet and copied paper, in which:

FIG. 31A is an example of an original document on which something is written;

FIG. 31B is an example of an area designation sheet on which a surrounded area is written;

FIG. 31C is an example of copy on paper; and

FIG. 32 is a flow chart explaining the steps in the working of the apparatus.

DETAILED DESCRIPTION OF THE PREFERRED EMBODIMENTS

One of the preferred embodiments of the present invention will be described with reference to the accompanying drawings.

Figure 1:
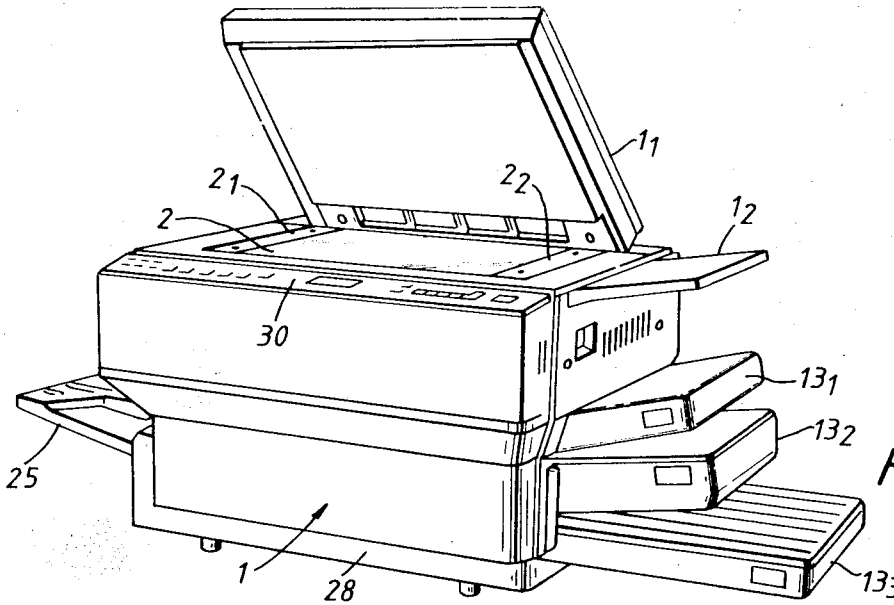
Figure 2:
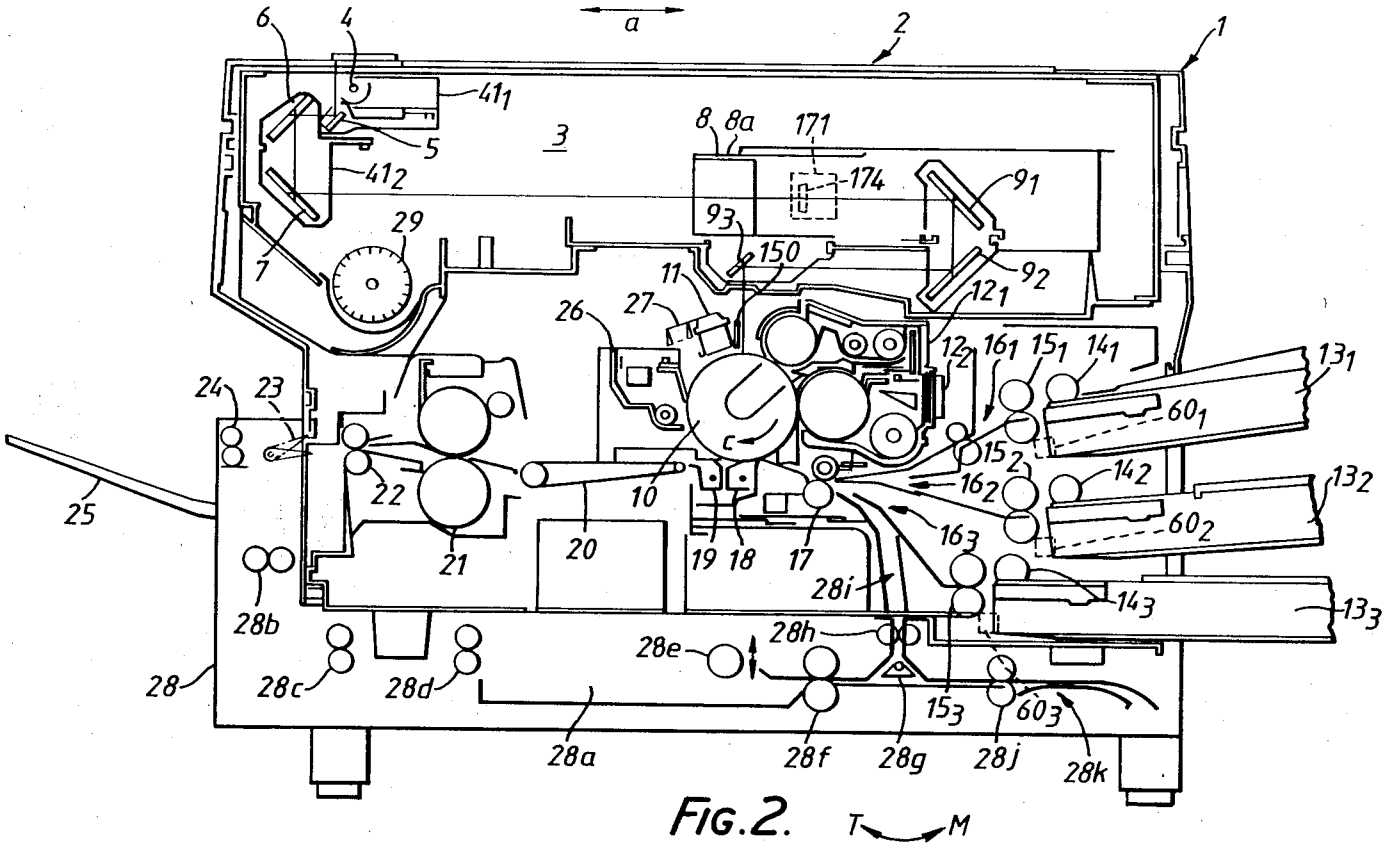

FIGS. 1 and 2 schematically show a copying machine as an image forming apparatus according to a first embodiment of the present invention. Reference number 1 denotes a copying machine housing. An original table 2 (i.e., a transparent plate) which support the original documents is provided on the upper surface of housing 1. Original table 2 has at least two original document areas capable of holding at least two documents placed on respective of the holding area. Fixed scales $2_1$ and $2_2$ are references for setting the original documents respectively at opposite ends of original table 2 along the longitudinal direction thereof. An openable original cover $1_1$ and a work table $1_2$ are provided close to original table 2.

The original documents placed on original table 2 are scanned by an optical system 3 consisting of an exposure lamp 4 and mirrors 5, 6 and 7 moving reciplocatively in the direction of the arrow a along the underside of original table 2. In this case, mirrors 6 and 7 move at half the speed of mirror 5 so as to maintain a fixed optical path length. The light reflected from the original document as a result of the scanning by the optical system, i.e., the light reflected from the original document as a result of illumination by the light from exposure lamp 4, passes through a lens block 8 capable of providing various different magnifications after being reflected by mirrors 5, 6 and 7, and is then guided to a photosensitive drum 10 by reflection from mirrors $9_1$, $9_2$ and $9_3$, to form an image of the original document on the surface of photosensitive drum 10.

Photosensitive drum 10 rotates in the direction indicated by arrow c so that its surface is wholly charged first by a main charger 11. The image of the original document is projected on the charged surface of photosensitive drum 10 by slit exposure, forming an electrostatic latent image on the surface. The electrostatic latent image is converted into visible image by the adhesion of, for example, red or black toner, stored in and selectively operated with developing devices $12_1$ and $12_2$ as required.

Copy paper sheets P are delivered one by one from a selected one of an upper paper-feed cassette $13_1$, middle paper-feed cassette $13_2$ or lower paper-feed cassette $13_3$, by paper-supply roller $14_1$, $14_2$ or $14_3$ and a pair of roller $15_1$, $15_2$ or $15_3$. Sheets P are guided along paper guide path $16_1$, $16_2$ or $16_3$ to an aligning roller pair 17. Then, each copy paper sheet P is delivered to a transferring station by the aligning roller pair 17, timed to the formation of the visible image.

Paper-feed cassettes $13_1$, $13_2$ and $13_3$ are removably attached to the lower part of the right side of housing 1, and any of them can be selected by operating on a control panel which will be described in detail later. The cassette size of each of paper-feed cassettes $13_1$, $13_2$ and $13_3$ is detected by cassette size detecting swtiches $60_1$, $60_2$ and $60_3$. These cassette size detecting switches $60_2$, $60_2$ and $60_3$ are each formed of a plurality of microswitches which are turned on or off in responce to insertion of cassettes of different sizes.

Paper sheet P delivered to the transferring station comes into intimate contact with the surface of photosensitive drum 10, in the space between a transfer charger 18 and drum 10. As a result, the toner image on photosensitive drum 10 is transferred to paper sheet P by charger 18. After the transfer, paper sheet P is separated from photosensitive drum 10 by a separation charger 19 and transported by a conveyor belt 20. As paper sheet P passes through fixing rollers 21, the transferred image is fixed on paper sheet P. After the fixation, paper sheet P is discharged by a pair of delivery rollers 22, a director gate 23 operated in the position shown by the solid line, and pair of discharge rollers 24, on to a tray 25 outside housing 1. After the transfer, any toner remaining on the surface of photosensitive drum 10 is removed by a cleaner 26. Thereafter, any image remaining on drum 10 is erased by a discharge lamp 27 to restore the initial state. Numeral 29 designates a cooling fan for preventing the temperature inside housing 1 from rising.

A multicopying unit 28, which permits copying on both sides of a paper sheet, or multiple copies on the same side, is provided at the bottom of housing 1. Thus unit 28 is provided with pairs of rollers **28*b*, 28*c* and 28*d* which guide the copy paper, which has been initially directed to unit 28 by director gate 23 and discharge rollers 24, to a storage part 28*a*. It is provided also with a delivery roller 28*e* for delivering paper which has been temporarily stored in storage part 28*a*. This delivery roller 28*e* can move up or down in the direction of the arrow in the drawing, according to the thickness (number of paper sheets) of the paper stored. The paper sheet delivered by delivery roller 28*e* is guided, via a pair of separating rollers 28*f* which separate one sheet at a time, to a control gate 28*g*. When multiple copying is required, this control gate 28*g* turns in the direction of the arrow M in the drawing, and the paper sheet is conveyed via the pair of conveyor rollers 28*h* and a paper guide route 28*i* to aligning roller pair 17. When coping on both sides is required, the paper is guided via a pair of conveyor rollers 28*j* to a reversing unit 28*k*, control gate 28*g* turns in the direction of arrow T in the drawing, and the paper sheet, sent by conveyor rollers 28*j*, is guided via conveyor rollers 28*h* and paper guide route 28*i* to aligning roller pair 17. In this embodiment, control gate 28*g*** is normally turned in the direction of arrow M, permitting multiple copying only.

Figure 3:
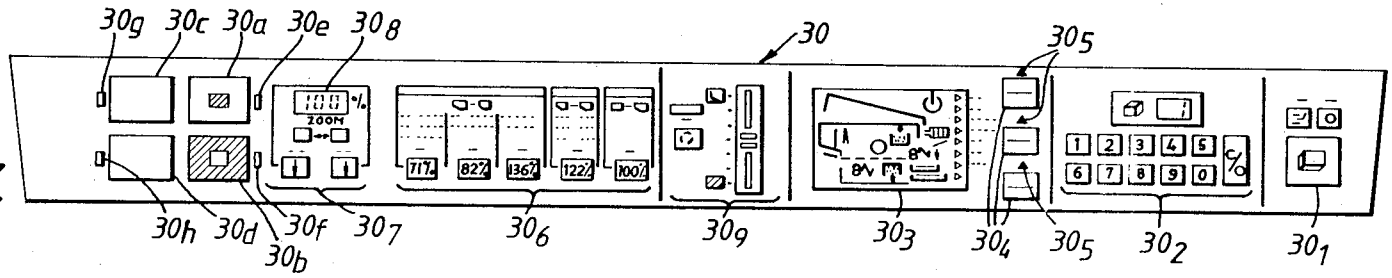

FIG. 3 shows a control panel 30 provided on housing 1. Control panel 30 carries thereon a copy key $30_1$ for starting the copying operation, a key board $30_2$ for setting the number of copies to be made and the like, a display section $30_3$ for indicating the operating conditions of the individual parts or paper jamming, cassete seletion keys $30_4$ for selecting upper, middle or lower paper cassette $13_1$, $13_2$ or $13_3$, and cassette display sections $30_5$ for indicating the selected cassette. Control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally control panel 30 is further provided with an "ERASE" key **30*a* for commanding the erasure (masking) of the image inside the surrounded area designated by an area designation sheet G2 which is explained later, an "ERASE" key 30*b* for commanding the erasure (trimming) of the image outside the surrounding area designated by area designation sheet G2, an "AREA READ" key 30*c* for commanding the read operation for area designation sheet G2, a "COLOR CHANGE" key 30*d* for commanding alteration of the copying color or commanding alteration of the copying color within the area designated by area designation sheet G2. Light-emitting elements 30*e*–30*h* for lighting in response to operation of keys 30*a*–30*d*** respectively.

Figure 4:
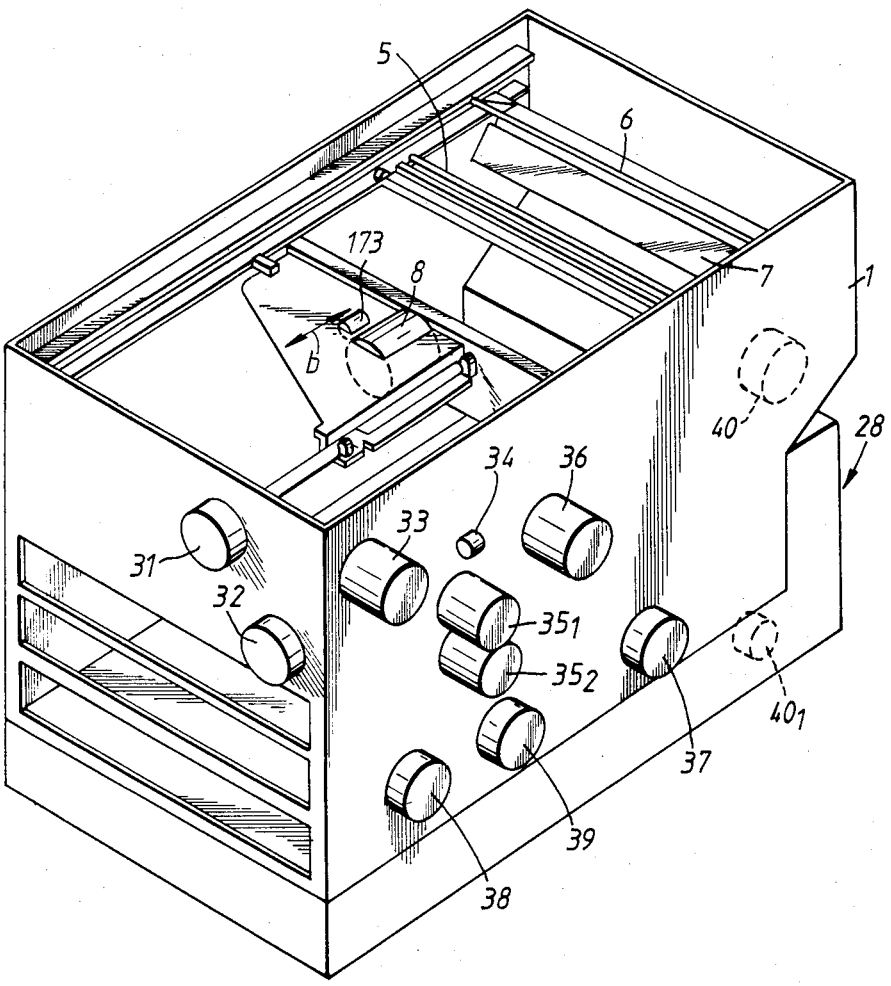

FIG. 4 shows an arrangement of the drive sources of the various drive units of the copying machine constructed as described above. The drive sources include the following motors. A lens drive motor 31 serves to shift the position of lens block 8 for magnification or reduction. A mirror drive motor 32 serves to change the distance (optical path length) between mirror 5 and mirror 6 and 7 for magnification or reduction. A stepping motor 33 moves exposure lamp 4 and mirrors 5, 6 and 7 for scanning the original document. A shutter drive motor 34 moves a shutter (not shown) for adjusting the width of charging of photosensitive drum 10 by charger 11 at the time of magnification or reduction.

Developing motors $35_1$ and $35_2$ drive the developing rollers and the like of developing units $12_1$ and $12_2$. A drum drive motor 36 drives photosesitive drum 10. A fixing motor drives paper conveyer belt 20, fixing rollers 21 and paper discharge rollers 24. A paper supply motor 38 drives paper supply rollers $14_1$–$14_3$. A sheet feed motor 39 drives aligning roller pair 17. A fan drive motor 40 drives cooling fan 29. A motor $40_1$ drives rollers **28*b*, 28*c* and 28*d***.

Figure 5:
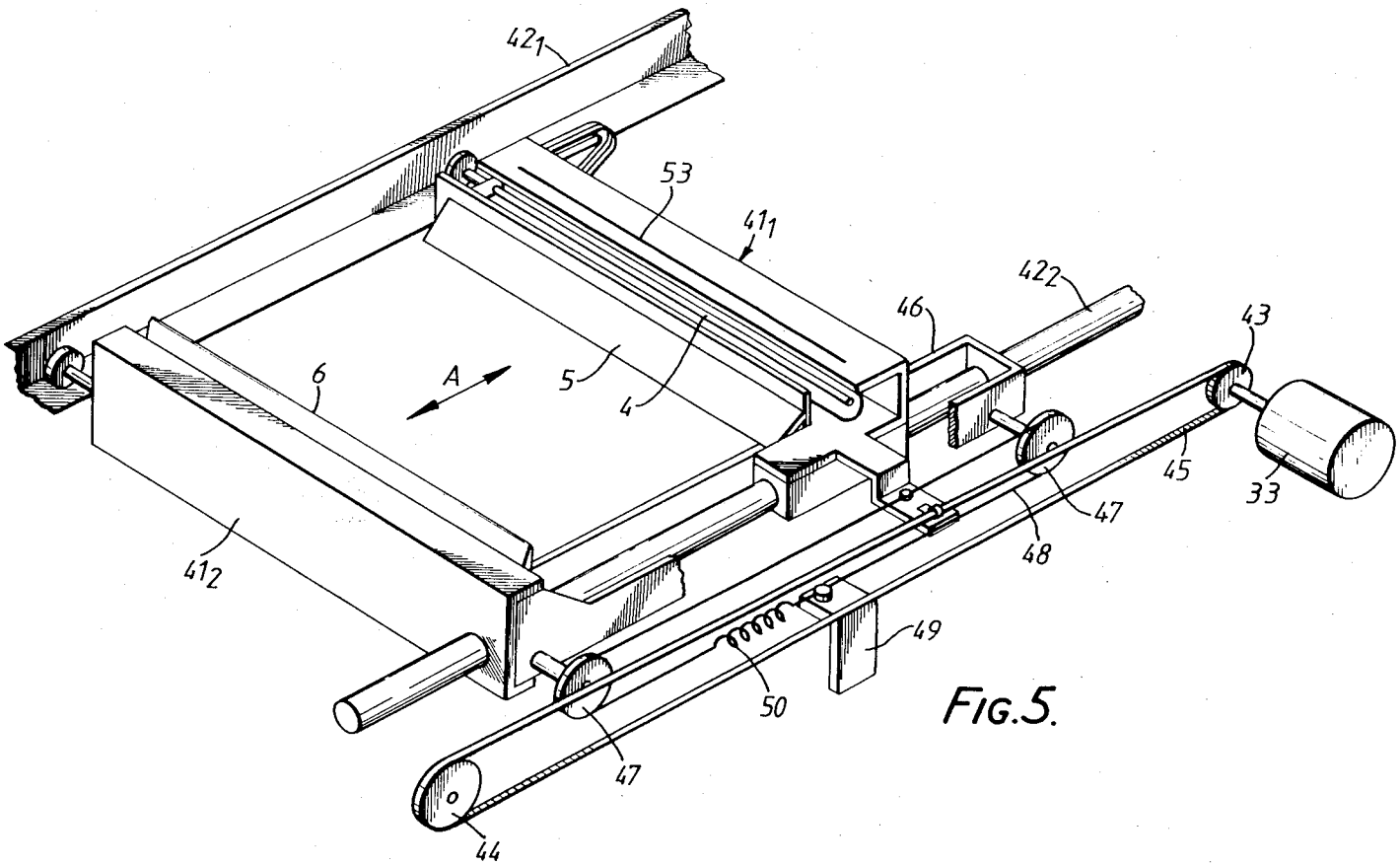

FIG. 5 shows a drive mechanism for reciprocating the optical system. Mirror 5 and exposure lamp 4 are supported by a first carriage $41_1$, and mirrors 6 and 7 are supported by a second carriage $41_2$. Carriages $41_1$ and $41_2$ can move in parallel in the direction indicated by arrow a, guided by guide rails $41_1$ and $42_2$. For-phase pulse motor 33 drives a pulley 43. An endless belt 45 is stretched between pulley 43 and an idle pulley 44, and one end of first carriage $41_1$ supporting mirror 5 is fixed to the middle portion of belt 45.

Two pulleys 47 are rotatably attached to a guide portion 46 (for rail $42_2$) of second carriage $41_2$ supporting mirrors 6 and 7, spaced in the axial direction of rail $42_2$. A wire 48 is stretched between pulleys 47. One end of wire 48 is connected directly to a fixed portion 49, while the other end is connected thereto by means of a coil spring 50. Coil spring 50 serves to give a tension to wire 48 for stretching wire 48 tightly between two pulleys 47. One end of first carriage $41_1$ is fixed to the middle portion of wire 48.

With this arrangement, when pulse motor 33 is driven, belt 45 turns around to move first carriage $41_1$. As first carriage $41_1$ travels, second carriage $41_2$ also travels. Since pulleys 47 then serve as movable pulleys, second carriage $41_2$ travels in the same direction as and at half the speed of first carriage $41_1$. The traveling direction of first and second carriages $41_1$ and $41_2$ is controlled by changing the rotating direction of pulse motor 33.

Original table 2 carries thereon an indication of a reproducible range corresponding to the size of designated paper sheets. If the sheet size designated by cassette selection keys $30_4$ and the copy ratio specified by ratio setting keys $30_7$ or $30_7$ are (Px, Py) and K, respectively the reproducible range (x, y) is given by $$x=Px/K,$$

$$y=Py/K.$$

Of this reproducible range (x, y), the x direction is indicated by pointers 51 and 52 (see FIG. 6) disposed on the reverse side of original table 2, while y direction is indicated by a scale 53 provided to the top surface of first carriage $41_1$ so as to visible through the glass of table 2.

Figure 6:
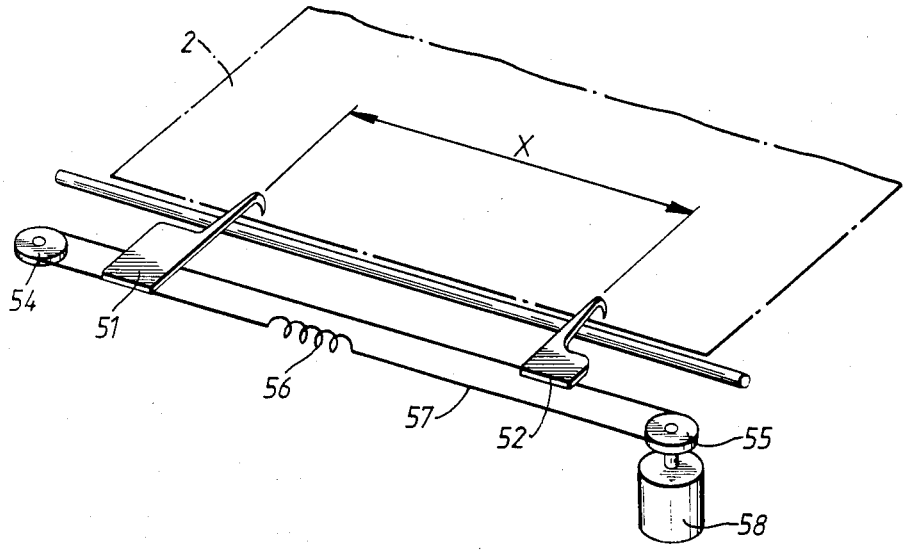

As shown in FIG. 6, pointers 51 and 52 are attached to a wire 57 which is stretched between pulleys 54 and 55 through the aid of a spring 56. Pulley 55 is rotated by a motor 58. The distance between pointers 51 and 52 can be changed by driving motor 58 in accordance with the sheet size and the enlargement or reduction ratio.

First carriage $41_1$ moves to a predetermined position (home position depending on the enlargement or reduction ratio) as motor 33 is driven in accordance with the sheet size and the ratio. When copy key $30_1$ is depressed, first carriage $41_1$ is first moved toward second carriage $41_2$. Then lamp 4 is lighted and first carriage $41_1$ is moved away from second carriage $41_2$. When the original scanning ends, lamp 4 is turned off, and first carriage $41_1$ is returned to the home position.

Figure 7:
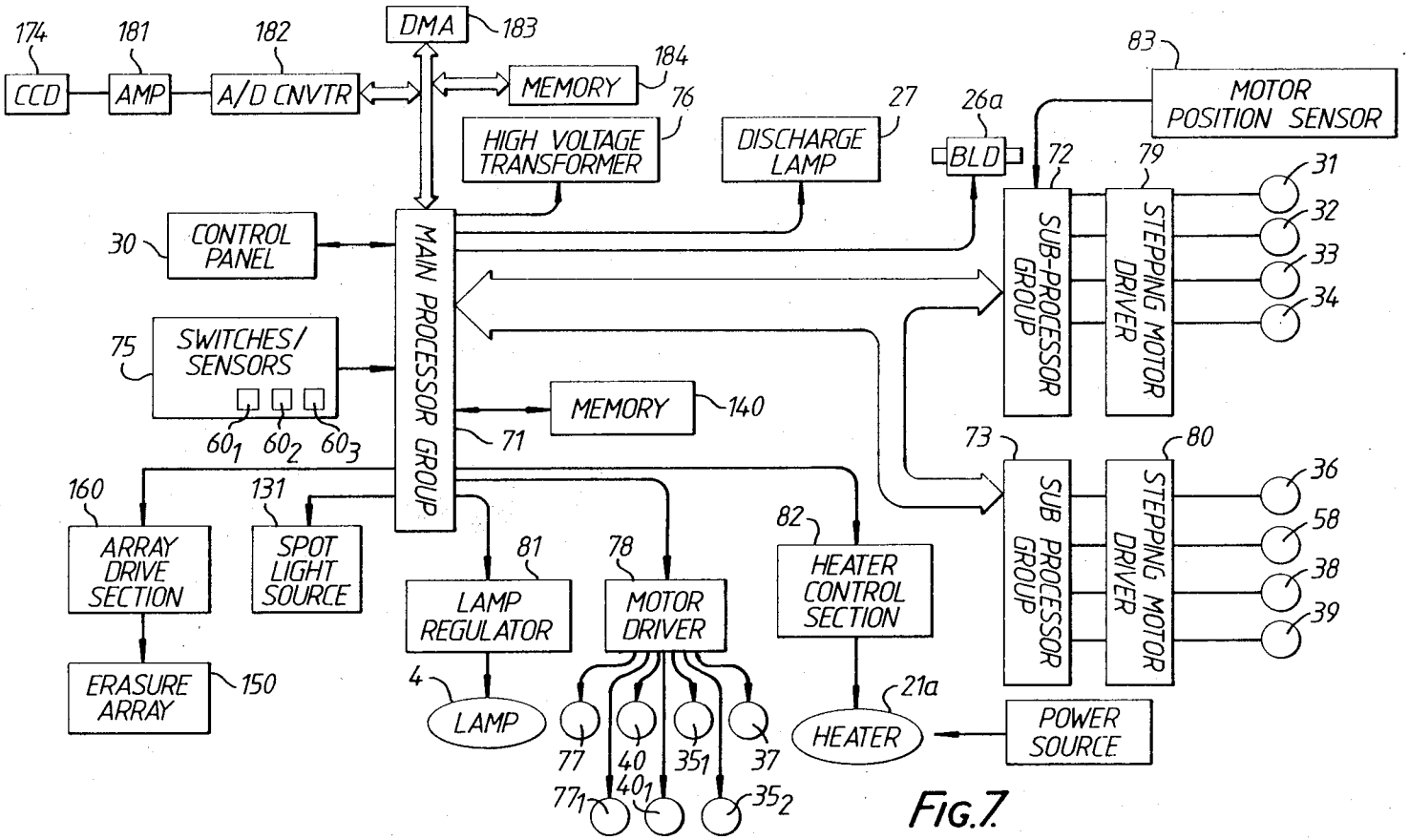

FIG. 7 shows a general circuit of the electronic copying machine. This control circuit is mainly composed of a main processeor group 71 and first and second sub-processor groups 72 and 73. Main processor group 71 detects input data from control panel 30 and a group of input devices 75 including various switches and sensors, such as the cassette size detection switches $60_1$, $60_2$ and $60_3$ and controls a high-voltage transformer 76 for driving the chargers, discharge lamp 27, a blade solenoid 26a of cleaner 26, a heater 21a of fixing roller 21, exposure lamp 4, and motors 31 to 40 and 58, thus accomplishing the copying operation. Main processor group 71 also controls a memory 140, an erasure array 150 and an array drive section 160, thereby erasing any unnecessary portions of the original document.

Furthermore, it operates color discrimination of the original document by controlling a Charge Coupled Device (CCD) 174, an amplifier 181, and A/D converter 182, a DMA (direct memory access unit) 183 and a memory 184. Incidentally, erasure array 150, array drive unit 160, memory 140, CCD 174, amplifier 181, A/D converter 182, DMA 183 and memory 184 are described later.

Motor $35_1$, $35_2$, 37, 40 and $40_1$ and a toner-supply motors 77 and $77_1$ for supplying the toner to developing units $12_1$ and $12_2$ are connected through a motor driver 78 to main processor group 71 to be controlled thereby. Motors 31 to 34 are connected through a stepping motor driver 79 to first sub-processor group 72 to be controlled thereby. Motors 36, 38, 39 and 58 are connected through a stepping motor driver 80 to second sub-processor group 73 to be controlled thereby.

Further, exposure lamp 4 is controlled by main processor group 71 through a lamp regulator 81, and heater 21a by main processor group 71 through a heater control section 82. Main processor group 71 gives instructions for the start or stop of the individual motors to first and second sub-processor groups 72 and 73. Thereupon, first and second sub-processor groups 72 and 73 feed to main processor group 71 with status signals indicative of the operation mode of the motors. Also, first sub-processor group 72 is supplied with positional information from a position sensor 83 for detecting the respective initial positions of motors 31 to 34.

Figure 8:
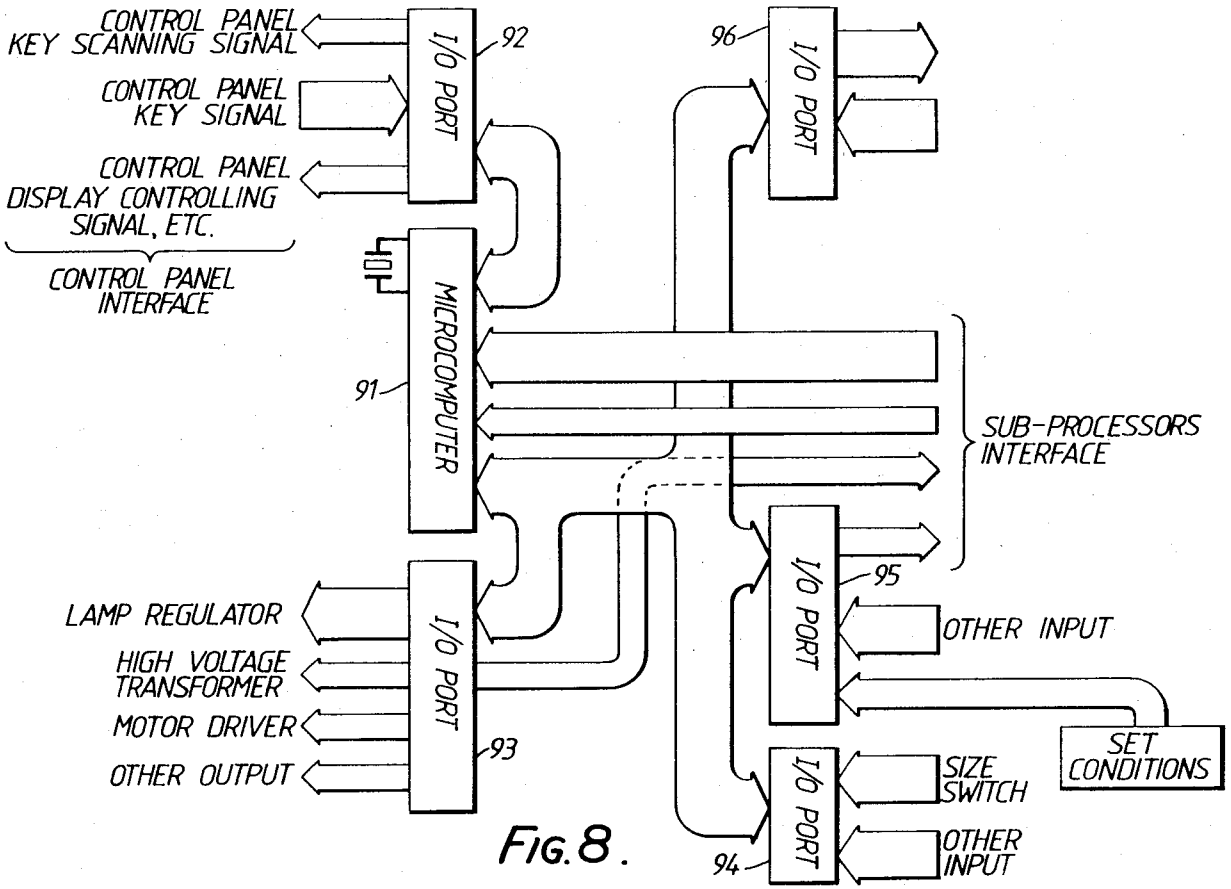

FIG. 8 shows an arrangement of main processor group 71. Reference number 91 denotes a one-chip microcomputer (to be referred to as a CPU hereinafter). CPU 91 detects key inputs at a control panel (not shown) through an I/O port 92 and controls display operations. CPU 91 can be expanded through I/O ports 93 to 96. Port 93 is connected to a high voltage transformer 76, a motor driver 78, a lamp regulator 81 and other outputs. Port 94 is connected to a size switch for detecting a paper size and other inputs. Port 95 is connected to a copying condition setting switch and other inputs. Port 96 is optional.

Figure 9:
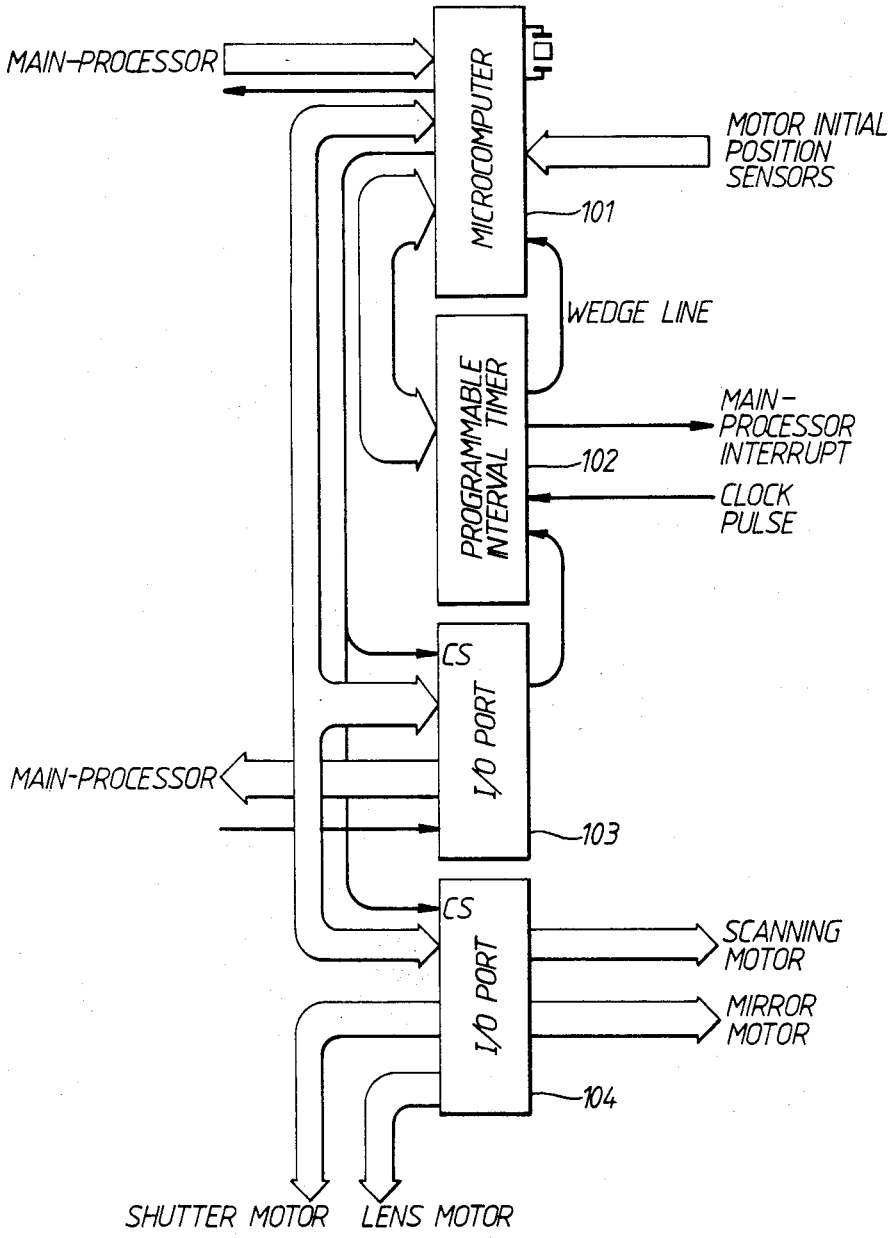

FIG. 9 shows an arrangement of first sub-processor group 72. Reference numeral 101 denotes a CPU connected to group 71. Reference numeral 102 denotes a programmable interbal timer for controlling switching time intervals. A preset value from CPU 101 is set in programable interval timer 102, and timer 102 then times a corresponding period. When timer 102 is stopped, timer 102 sends an end pulse onto an interrupt line of CPU 101. Timer 102 receives a reference clock pulses. CPU 101 receives position data from a position sensor 83 and is connected to I/O ports 103 and 104. Port 104 is connected to motors 31 to 34, 67 and 135 through stepping motor driver 79. Port 103 is used to supply a status signal from each pulse motor to group 71.

Figure 10:
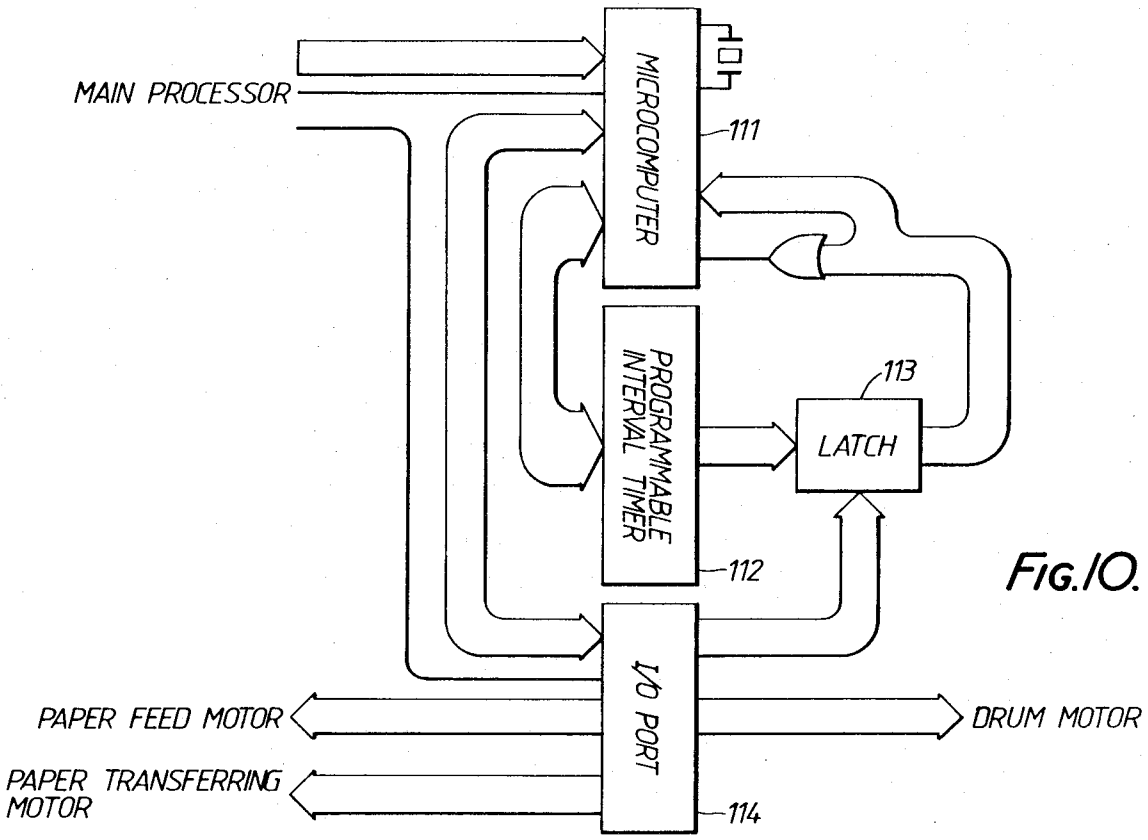

FIG. 10 shows an arrangement of second sub-processor group 73. Reference numeral 111 denotes a CPU connected to group 71. Reference numeral 112 denotes a programmable interval timer for controlling switching time intervals of the stepping motors. A preset value from CPU 111 may be set in programmable interval timer 112, and timer 112 is then times a corresponding period. When timer 112 stopped, it generates an end pulse. The end pulse is latched by a latch circuit 113, and an output therefrom is supplied onto the interrupt line of CPU 111 and the input line of the I/O port. CPU 111 is connected to an I/O port 114 which is then connected to motors 36, 38, 39 and 58 through driver 80.

FIG. 11 shows a stepping motor control circuit. An I/O port 121 (corresponding to ports 104 and 114 of FIGS. 9 and 10) is connected to a stepping motor driver 122 (corresponding to drivers 79 and 80 of FIG. 11). Driver 122 is connected to windings A, A, B and B of a stepping motor 123 (corresponding to motors 31 to 34, 36, 38, 39, 58, 67 and 135).

FIGS. 12A and 12B show a method of controlling a stepping motor speed. FIG. 12A shows a stepping motor speed curve, and FIGS. 12B shows switching intervals. As is apparent from FIGS. 12A and 12B, the switching intervals are long at the biginning, are gradually decreased until a predetermined interval is reached. When stopping is desired, the intervals are gradually increased, and the stepping motor is finally stopped. This cycle indicated the through-up and through-down of the pulse motor. The motor is started from the self starting region, operated in a high-speed region and is gradually stopped. Reference symbols t1, t2, . . . , tx denote times between the switching intervals.

Figure 13:
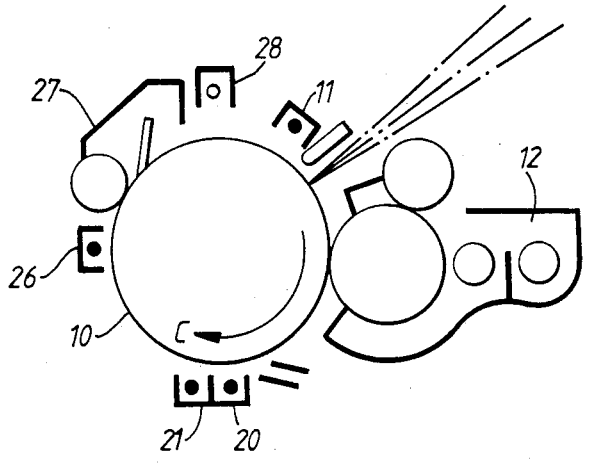
Figure 15:
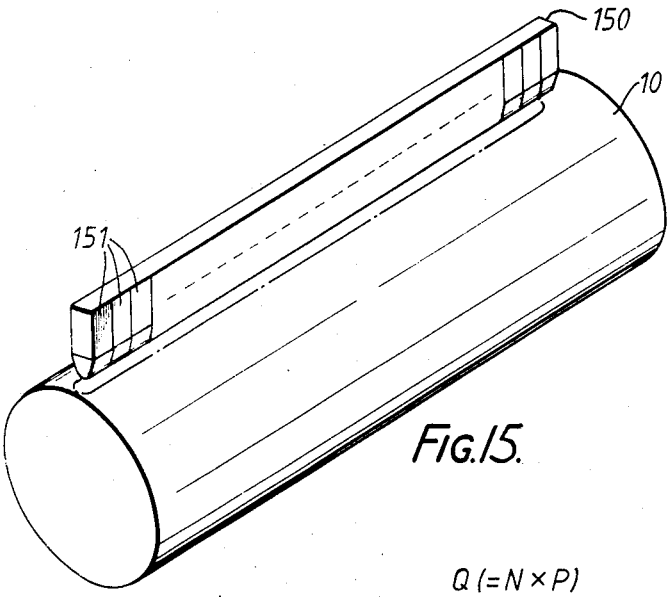
Figure 16:
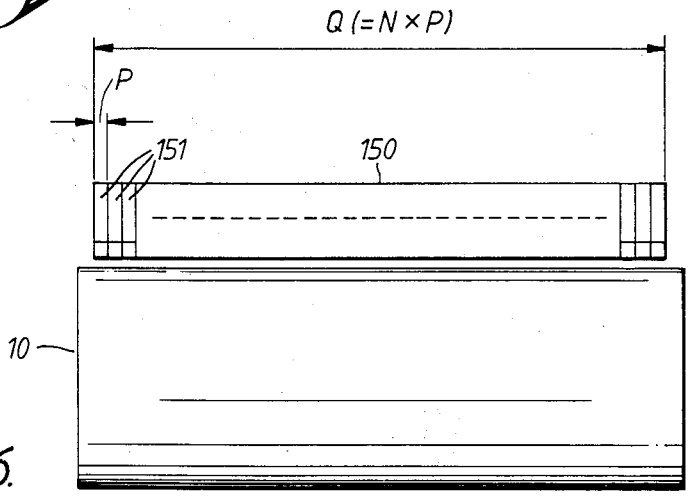
Figure 17A:
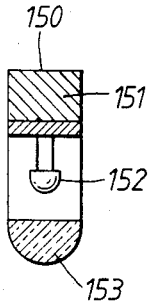
FIG. 17A is a side sectional view of the erasure array.
Figure 17B:
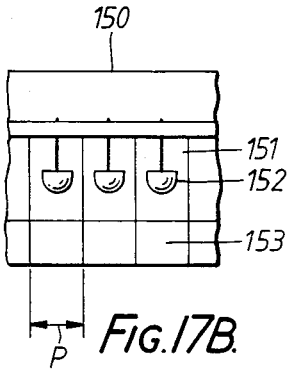
FIG. 17B is a partial front view of the erasure array.

Next, the means for erasing original document is described. As shown in FIG. 13, an erasure array 150 as the erasing means is disposed close to photosensitve drum 10, between charger 11 and an exposure region Ph, for example. As shown in FIGS. 15 and 16, erasure array 150 includes a plurality of shading cells 151 which are arranged in a direction perpendicular to the rotating direction of photosensitive drum 10. As shown in FIGS. 17A and 17B, cells 151 each contains therein a light emitting element 152 formed of, e.g., a light emitting diode. Moreover, a lens 153 for converging light from light emitting element 152 on the surface of photosensitive drum 10 is disposed at the opening portion of each cell 151 facing photosensitive drum 10.

The number of light-emitting elements arranged in erasure array 150 corresponds to the column capacity of memory 140. When the width of each light-emitting element 152 is given by P and the number of element is given by N, overall length Q of array 150 is given by $Q=N\cdot P$.

Figure 18:
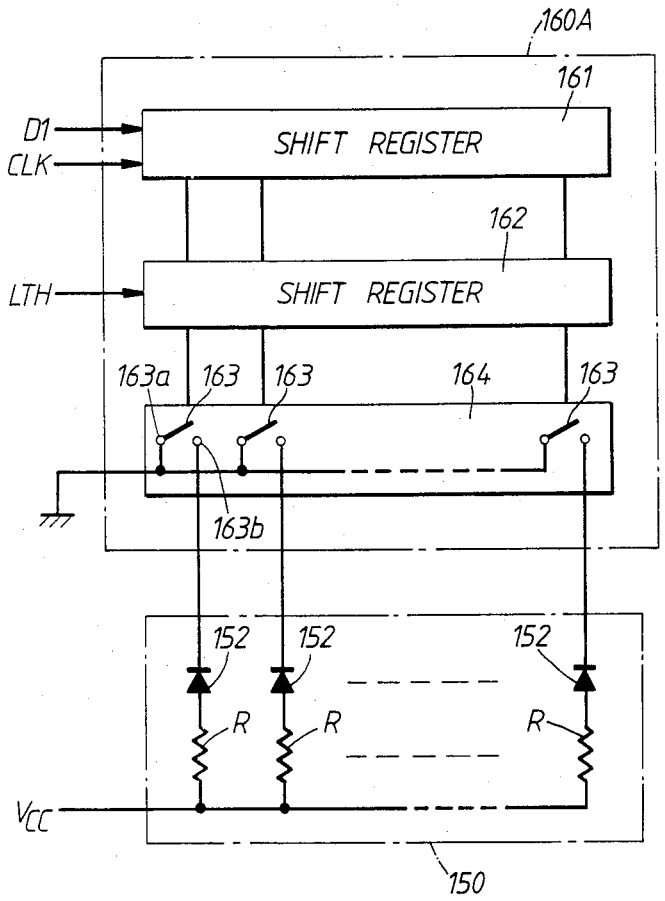

Array 150 is driven by an array drive section 160. As shown in FIG. 18, section 160 comprises a shift register 161 having the same bit number as the rank bit number of memory 140, a store register 162 for storing the content of register 161, and a switching circuit 164 consisting of a plurality of switching elements 163 which are turned on/off in response to output signals from register 162. Movable contacts **163*a* of elements 163 are grounded, and stationary contacts 163*b* thereof are respectively connected to the cathodes of elements (diodes) 152 constituting array 150. The anodes of elements 152** are connected to a power source VCC through the corresponding current limiting resistors R.

Figure 19A:
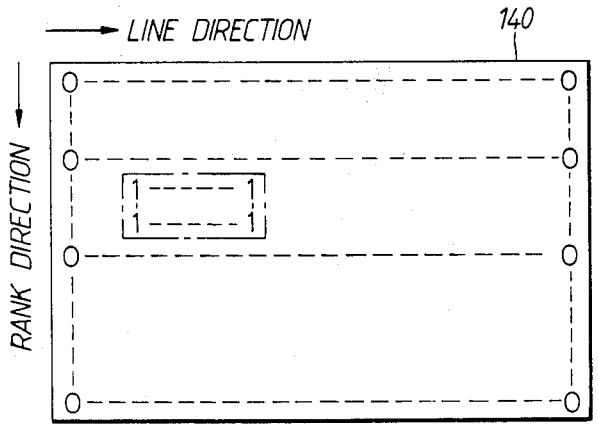
FIGS. 19A and 19B are diagrams explaining the respective contents of the memory.
Figure 19B:
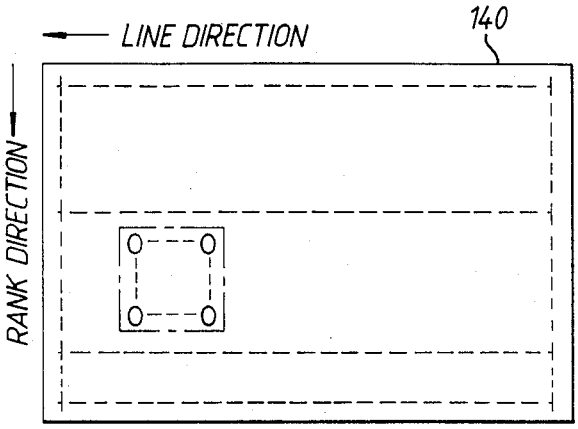

FIGS. 19A and 19B show memory 140. This memory 140 is composed of a RAM in which the capacity in the direction of each column is made to coincide with the number of light emitting elements 152 making up erasure array 150 and the bit number of shift register 160, and the capacity in the line direction is made the bit number corresponding to the required degree of resolution for original table 2. In this memory 140, the erasure data corresponding to the designated erasure area is stored by the control of main processor group 71. As shown in FIGS. 19A and 19B, it is designed so that, for example, the high-level signal "1" is stored at addresses which correspond to the designated erasure area and the low-level signal "0" is stored at other addresses.

The operation of erasing in the construction described above will now be explained. When first carriage $41_1$ and photosensitive drum 10 are operated, in the state in which erase data are stored in memory 140 as described above, data read one rank at a time from memory 140 in the line direction (indicated in FIGS. 19A and 19B). The readout data D1 are transferred to register 161 in section 160 in response to the clock signal CLK. After one-rank data is transferred to register 161 and the changed portion of drum 10 reaches array 150, group 71 generates a latch signal LTH. The storage data is supplied from register 161 to register 162 in response to the latch signal LTH. Since array 150 is arranged between charger 11 and exposure portion Ph, the output timing of the latch signal LTH is controlled such that the one-rank data is transferred from memory 140 to register 162 prior to $\theta 1/\omega$ where $\theta 1$ is the angle between array 150 and portion Ph and $\omega$ is the peripheral velocity of drum 10.

Elements 163 in circuit 164 are controlled in response to the output signal from register 162. When the output of register 162 is set at high level, element 163 are turned on. When the output of register 162 is set at low level, elements 163 are turned off. Elements 152 connected to elements 163 are turned on when elements 163 are turned on. Otherwise, elements 152 are turned off. A charged drum portion corresponding to the ON elements 152 is discharged, and the remaining portion is not discharged, so that a latent image is not formed in the discharged portion even if the surface of drum 10 is exposed with light. In this manner, the unnecessary portion for one rank is erased. The data is thus read out from memory 140 in units of ranks, thereby erasing the unnecessary image portion.

Figure 20:
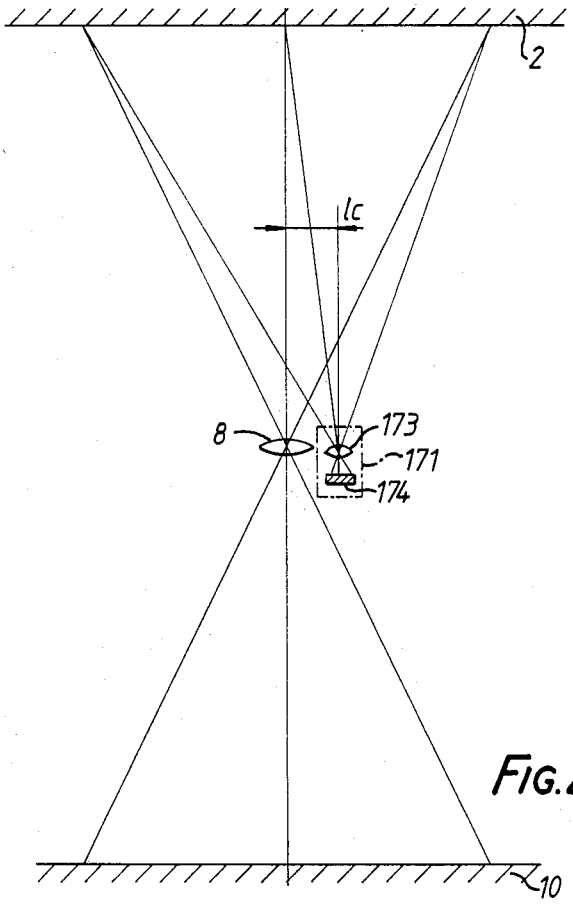

Next, reading unit 171 for reading the designated area (surrounded area) of an area designation sheet G2 is described. As shown in FIGS. 2, 4 and 20, reading unit 171 is provided in the vicinity of lens block 8. It is composed of lens 173 which transmits an optical image from the original document, and CCD 174 on which this optical image is formed.

Figure 23:
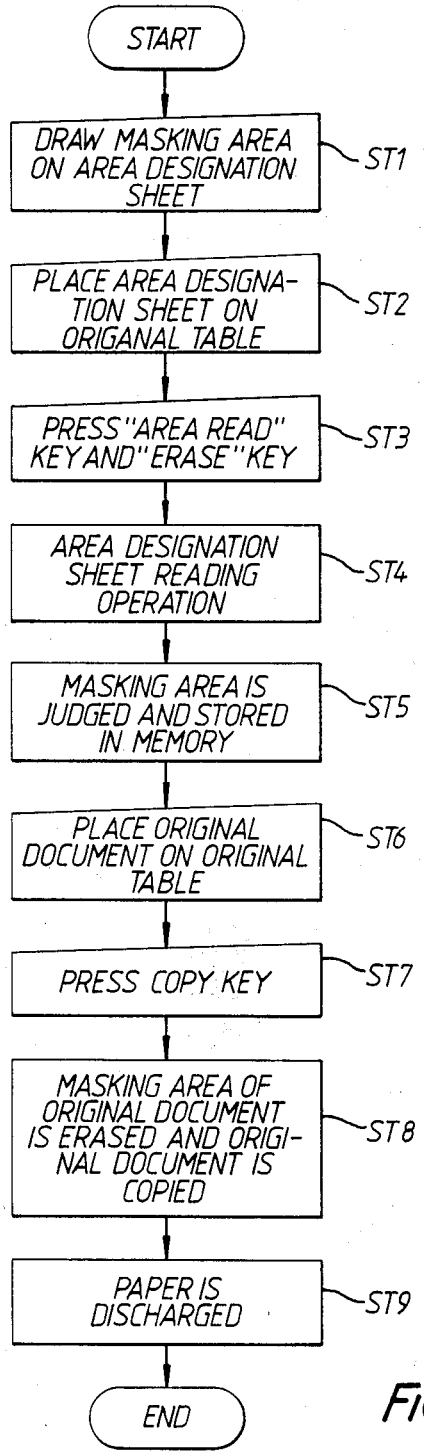

The copying operation relating to this first embodiment of the present invention in the above construction is described below referring the flow chart shown in FIG. 23.

Figure 21A:
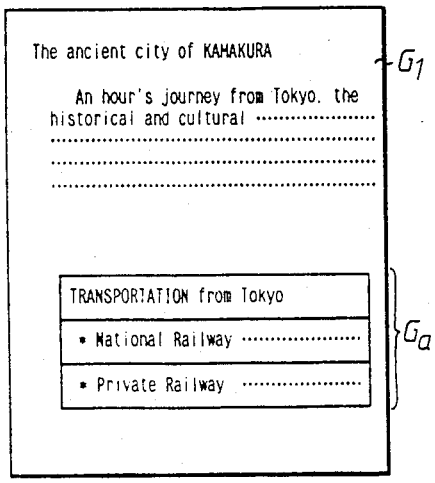
Figure 21B:
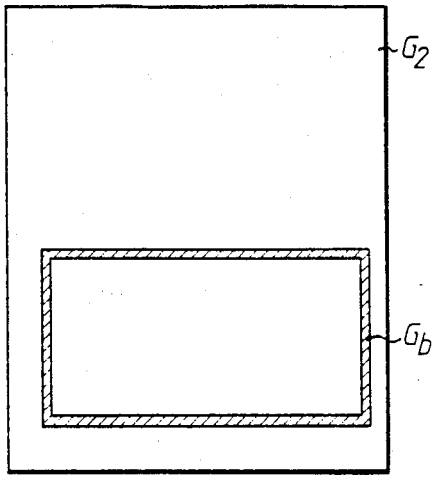

First, as shown in FIG. 21A, when original document G1 is printed in black and the area Ga of original document G1 is masked (erased), area designation sheet G2 is superimposed on original document G1 and, as shown in FIG. 21B, the area of area designation sheet G2 corresponding to the area Ga is surrounded with blue coloring the area Gb as shown by the slanting lines (ST1). That is, the masking area is drawn on area designation sheet G2.

Figure 22:
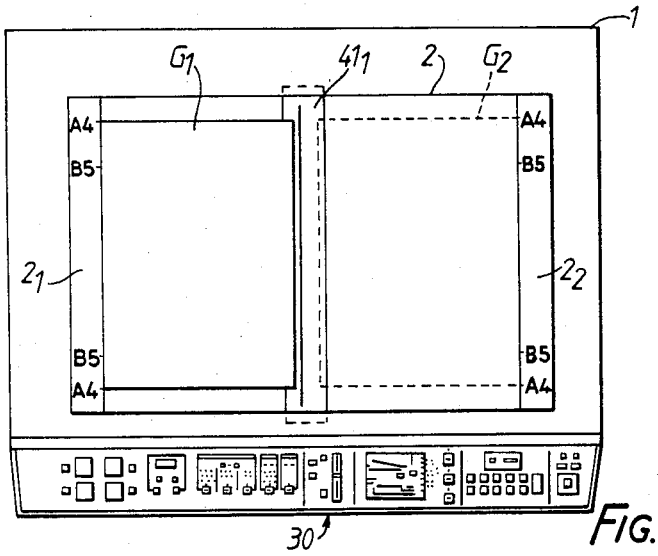

Next, the operator aligns area designation sheet G2 on original table 2 (ST2) and presses "AREA READ" key **30*c* and "ERASE" key 30*a* (ST3). When this is done, first carriage $41_1$ is moved in the direction away from fixed scale $2_1$ (see FIG. 22) while photosensitive drum 10, etc, remain stopped, and exposure scanning of area designation sheet G2 is carried out. Along with this scanning, the reflected light from area designation sheet G2 is transmitted by lens 173 to CCD 174. The photoelectric conversion output signals of CCD 174 are supplied to A/D converter 182 via amplifier 181 shown in FIG. 7 and are converted into digital signals. These converted signals are stored in memory 184 via DMA 193 (ST4). Then, the blue-surrounded area Gb, in other words the erasure area, is judged based on the stored position data for blue-surrounded area Gb and erasure data for this erasure area is generated and stored in memory 140**. That is, high-level signals are stored at the addresses corresponding to the area of blue-surrounded area Gb and low-level signals are stored at the other addresses (ST5).

Next, the operator sets original document G1 on original table 2 (ST6), and presses copy key $30_1$ (ST7). When this is done, copying action will be carried out on the black section of original document G1 using developer $12_2$, in which black toner is stored, and erasure array 150. That is, first carriage $41_1$ is moved and exposure scanning is carried out on original document G1.

Figure 21C:
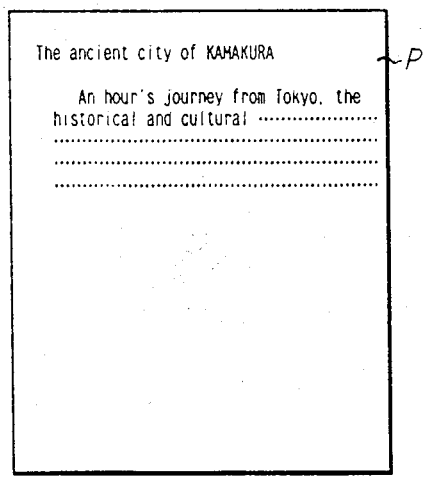

In conjunction with this, erasure data are supplied to array driver 160 from memory 140. Erasure array 150 is operated in response to this erasure data and the electrostatic charge on photosensitive drum 10 corresponding to the blue-surrounded area Gb is erased. Consequently, when remain electrostatic latent image is developed and developed image is transferred on to paper P, as shown in FIG. 21C (ST8). Paper P on which the erasure area in original document G1 designated by area designation sheet G2 not copied is sent to tray 25 via fixing rollers 21, discharge rollers 24 (ST9).

Moreover, although the designation of the above erasure area was for one place only, the same operation can be carried out even for more than one designated area.

Also, even when "ERASE" key 30b is pressed instead of "ERASE" key 30a, it operates in the same way as above so that an image of the original document in which the image outside the area designated by the area designation sheet has been erased is copied on paper P.

Incidentally, in the above construction, when "AREA READ" key 30c is not operated, normal copying action is provided. In this state, if "COLOR CHANG" key 30d is operated, copying is carried out using red or black toner.

The above embodiment is designed so that the erasure area of the original document to be copied is designated on an area designation sheet, other than the original document to be copied, which is placed on the original table first. This designated erasure area is discriminated by a reader unit and stored in a memory. Next, the image of the designated area is erased from the image of the original document which is placed on the original table and the original document is then copied by suitably controlling array driver 160 and erasure array 150 in response to the discrimination information. Consequently, since erasure of a required area of an original image is possible by a comparatively simple construction, when editing original images, this invention is very useful. Moreover, designation of the erasure area can be carried out directly looking at the original document and also the erasure area can be designated without soiling the original document to be copied.

Also, it is convenient in practical use since it is possible easily to designate the erasure area of the original document.

Moreover, it is possible to keep the area designation sheet for later checking and the corresponding original document can be used again and again.

Figure 14:
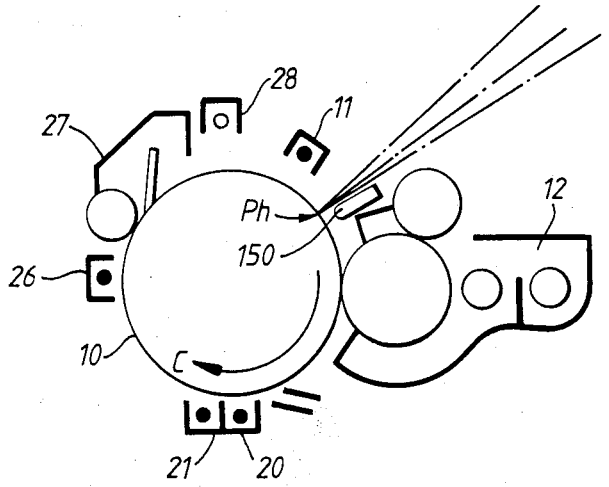

Furthermore, the position of erasure array 150 is not restricted to that shown in FIG. 13. It can be disposed between exposure unit Ph and developing unit $12_1$, as shown in FIG. 14, and may be constructed so that it erases a formed electrostatic latent image in response to designation. The case when the erasure area is surrounded has been described, but the erasure area may also be covered with paint.

Moreover, the color for designating the erasure are of the original document is not confined to blue, other colors may be used.

A second embodiment of the present invention will be described hereinafter. If no description is given, the constitution of the second embodiment is the same as that of the first embodiment.

Figure 24:
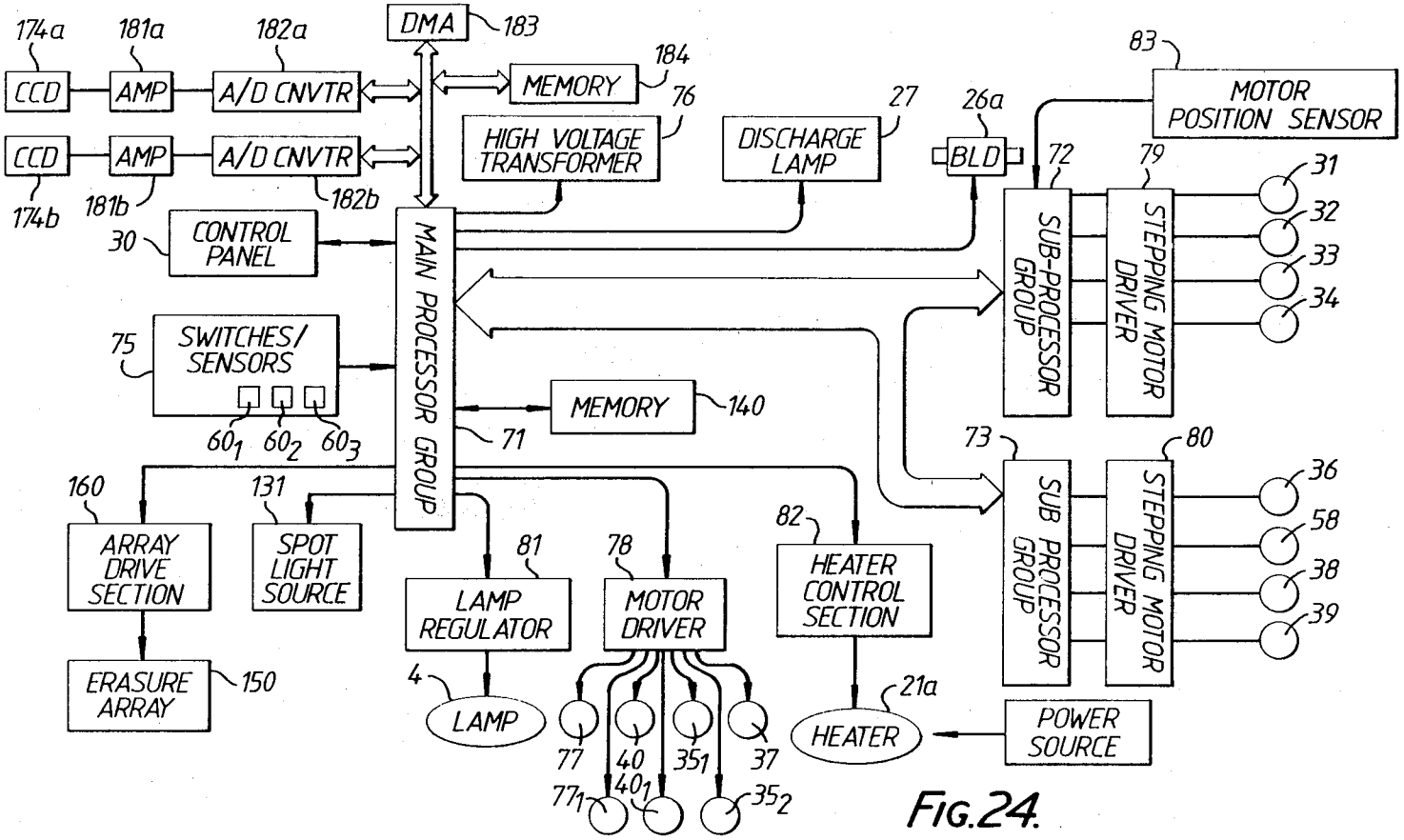

As shown in FIG. 24, a first CCD 174a is connected to main processor group 71 via a first amplifier 181a and a first A/D converter 182a, and a second CCD 174b is connected to main processor group 71 via a second amplifier 181b and a second A/D converter 182b. It operates color discrimination of the coloring surrounded area of an area designation sheet G2 (see FIG. 25B) by controlling CCDs 174a and 174b, amplifiers 181a and 181b, A/D converters 182a and 182b, DMA (direct memory access unit) 183 and memory 184. Incidentally, erasure array 150, array drive section 160, memory 140, CCDs 174a and 174b, amplifiers 181a and 181b, A/D converters 182a and 182b, DMA 183 and memory 184 are described later.

Figure 26:
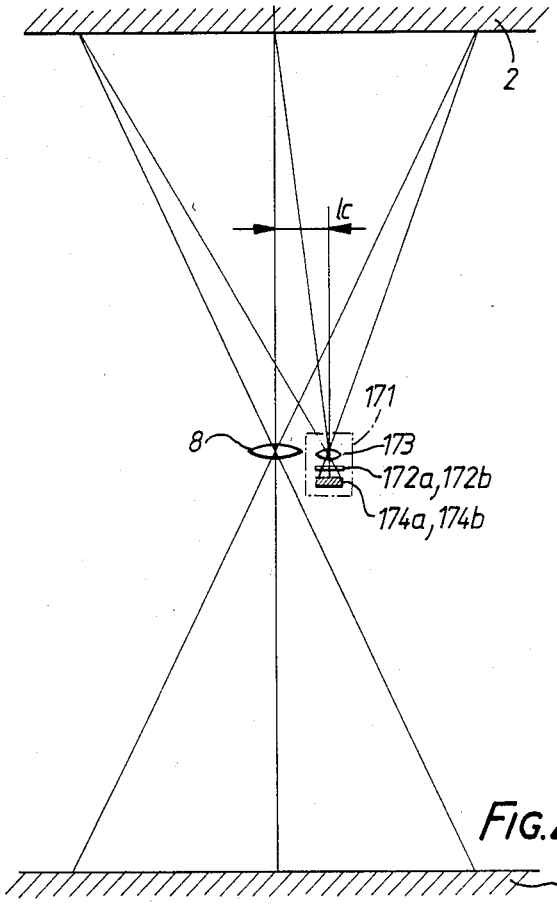

Next, reading unit 171 for reading the designated area (surrounded area ) of area designation sheet G2 is described. As shown in FIG. 26, reading unit 171 is provided in the vicinity of lens block 8. It is composed of lens 173 which transmits an optical image from the original document, CCDs 174a and 174b on which this optical image is formed, and color filters 172a and 172b which are inserted between these CCDs 174a and 174b and lens 173. Color filters 172a and 172b are, for example, a combination of grey and red, grey and blue, etc.

Figure 27A:
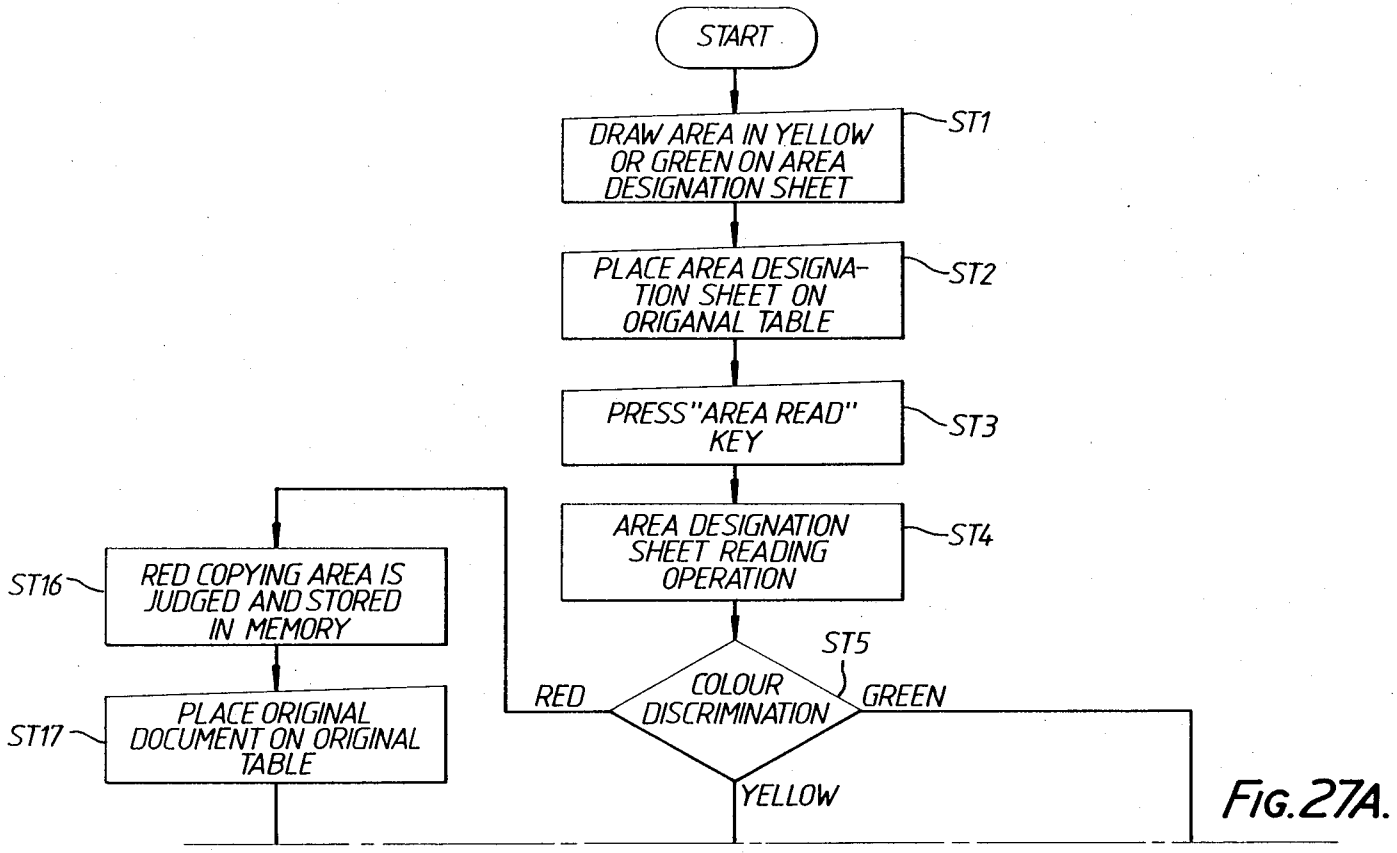
Figure 27B:
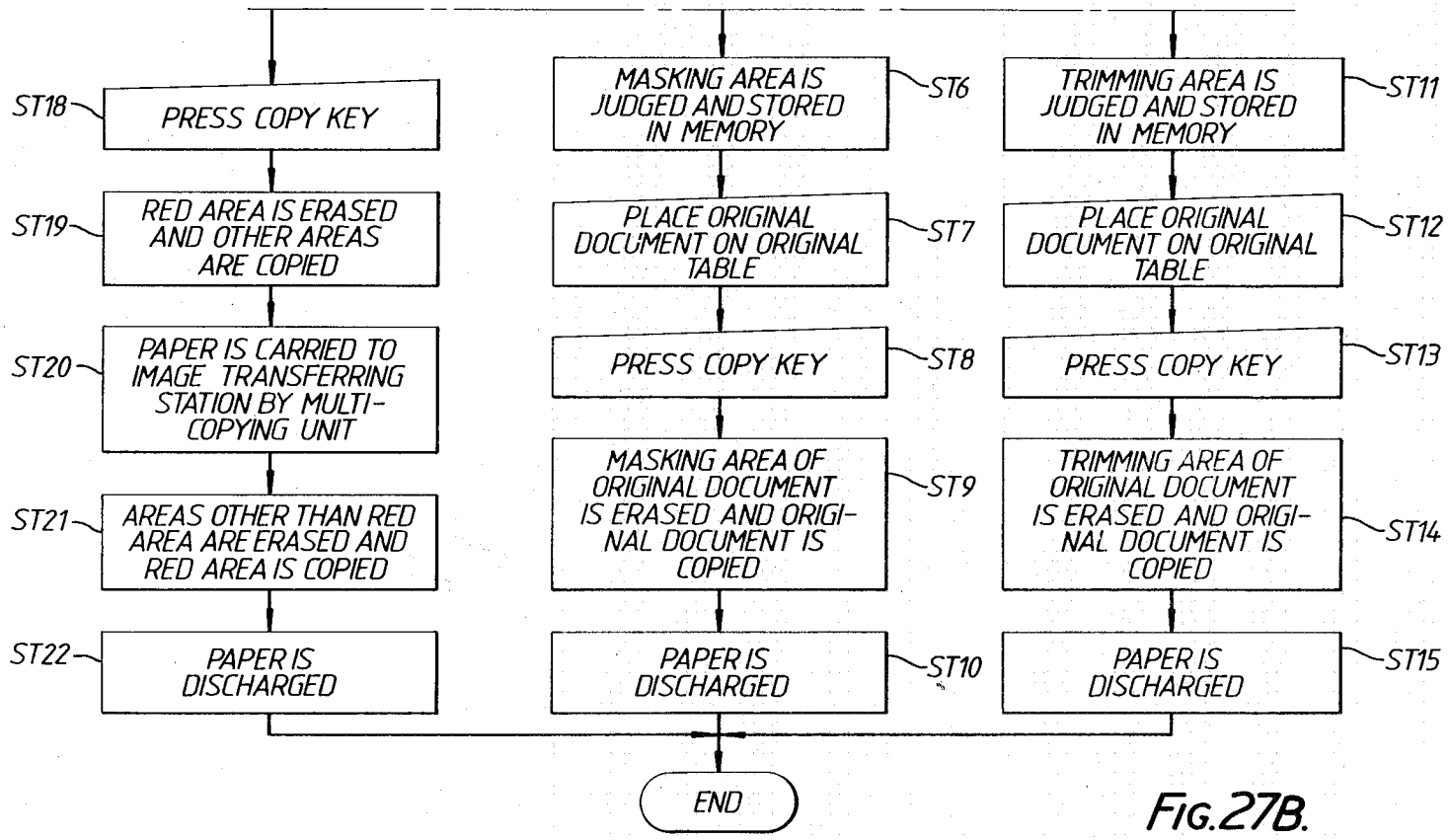

The copying operation relating to this second embodiment of the present invention in the above construction is described below referring the flow chart shown in FIG. 27.

The corresponding to the area Ga of original document G1 required to be masked is surrounded in yellow coloring, the corresponding to the area Ga required to be trimmed is surrounded in green coloring, and the corresponding to the area Ga where red copying is required is surrounded in red coloring on area designation sheet G2.

Figure 25A:
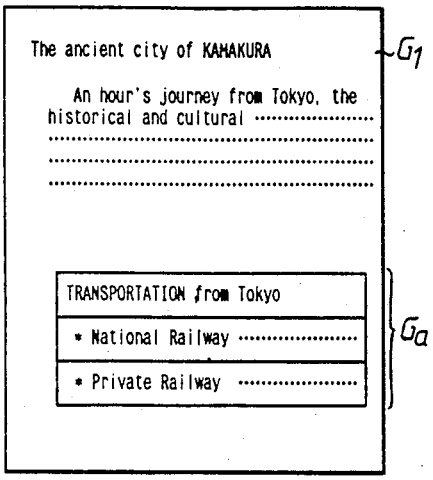
Figure 25B:
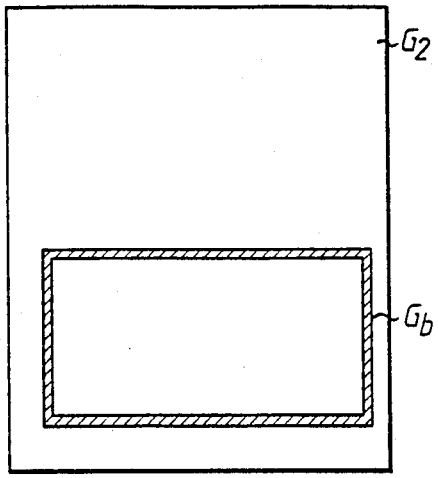

As shown in FIG. 25A, when original document G1 is printed in black and area Ga of original document G1 is masked (erased), area designation sheet G2 is superimposed on original document G1 and, as shown in FIG. 25B, the area of area designation original G2 corresponding to the area Ga is surrounded with yellow coloring the area Gb as shown by the slanting lines (ST1). That is, the masking area is drawn on area designation sheet G2.

Next, the operator aligns area designation sheet G2 with fixed scaled $2_2$ on original table 2 (ST2) and presses "AREA READ" key 30c (ST3). When this is done, first carriage $41_1$ is moved in the direction away from fixed scale $2_1$ while photosensitive drum 10, etc, remain stopped, and exposure scanning of area designation sheet G2 which is placed at the side of fixed scale $2_2$ is carried out. Along with the scanning, the reflected light from area designation sheet G2 is transmitted by lens 173 to CCDs 174a and 174b via color filters 172a and 172b respectively. The photoelectric conversion output signals of CCDs 174a and 174b are respectively supplied to A/D converters 182a and 182b via amplifiers 181a and 181b shown in FIG. 24 and are converted into digital signals. Each of these converted signals is stored in memory 184 via DMA 183 (ST4). When scanning is completed by first carriage $41_1$, the color discrimination process can be carried out by two types of image information data stored in memory 184. That is, addition and subtraction is carried out between the 2 types of information stored data in memory 184, yellow is discriminated and position data for the yellow-surrounded area Gb is stored in memory 184 (ST5).

Then, the yellow-surrounded area Gb, in other words the masking area, is judged based on the stored position data for the yellow-surrounded area Gb and erasure data for this masking area is generated and stored in memory 140. That is, high-level signals are stored at the addresses corresponding to the area of the yellow-surrounded are Gb and low-level signals are stored at the other addresses (ST6).

Next, the operator lines up original document G1 on setting scale $2_1$ of original table 2 (ST7), and presses copy key $30_1$ (ST8). When this is done, copying action wil be carried out on parts other than the area Ga of original document G1 using developing unit $12_2$, in which black toner is stored, and erasure array 150. That is, first carriage $41_1$ is moved and exposure scanning is carried out on original document G1.

Figure 25C:
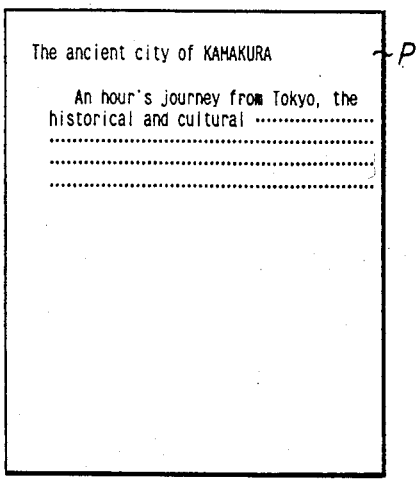

In conjunction with this, erasure data are supplied to array driver 160 from memory 140. Erasure array 150 is operated in response to this erasure data and the electrostatic charge on photosensitive drum 10 corresponding to the yellow-surrounded area Gb is erased. Consequently, when remain electrostatic latent image is developed and developed image is transferred on to paper P, as shown in FIG. 25C (ST9). Paper P on which the erasure area in original document G1 designated by area designation sheet G2 not copied is sent to tray 25 via fixing rollers 21, discharge rollers 24 (ST10).

Next, as shown in FIG. 25A, when original document G1 is printed in black and area Ga of original document G1 is trimmed, area designation sheet G2 is superimposed on original document G1. Then, as shown in FIG. 25B, the area of area designation sheet G2 corresponding to the area Ga is surrounded with green coloring area Gb as shown by the slanting lines (ST1). That is, the trimming area is drawn on area designation sheet G2.

Next, the operator aligns area designation sheet G2 with fixed scale $2_2$ on original table 2 (ST2) and presses "AREA READ" key 30c (ST3). When this is done, first carriage $41_1$ is moved in the direction away from fixed scale $2_1$ while photosensitive drum 10, etc, remain stopped, and exposure scanning of area designation sheet G2 which is placed at the side of fixed scale $2_2$ is carried out. Along with this scanning, the reflected light from area designation sheet G2 is transmitted by lens 173 to CCDs **174*a* and 174*b* via color filters 172*a* and 172*b* respectively. The photoelectric conversion output signals of CCDs 174*a* and 174*b* are respectively supplied to A/D converters 182*a* and 182*b* via amplifiers 181*a* and 181*b* shown in FIG. 24 and are converted into digital signals. Each of these converted signals is stored in memory 184 via DMA 183 (ST4). When scanning is completed by first carriage $41_1$, the color discrimination process can be carried out by two types of image information data stored in memory 184. That is, addition and subtraction is carried out between the two types of information stored data in memory 184, green is discriminated and position data for green-surrounded area Gb is stored in memory 184** (ST5).

Then, the area outside of the green-surrounded area Gb, in other words the trimming area, is judged based on the stored position data for the green-surrounded area Gb and erasure data for this trimming area is generated and stored in memory 140. That is, low-level signals are stored at the addresses corresponding to the area of green-surrounded area Gb and high-level signals are stored at the other addresses (ST11).

Next, the operator lines up original document G1 on setting scale $2_1$ of original table 2 (ST12), and presses copy key $30_1$ (ST13). When this is done, copying action will be carried out on the area Ga section of original document G1 using developing unit $12_2$, in which black toner is stored, and erasure array 150. That is, first carriage $41_1$ is moved and exposure scanning is carried out on original document G1.

In conjunction with this, erasure data are supplied to array driver 160 from memory 140. Erasure array 150 is operated in response to this erasure data and the electrostatic charge on photosensitive drum 10 corresponding to the area outside of the green-surrounded area Gb is erased. Consequently, when remain electrostatic latent image is developed and developed image is transferred on to paper P (ST14). Paper P on which the trimming area in original document G1 designated by area designation sheet G2 copied is sent to tray 25 via fixing rollers 21, discharge rollers 24 (ST15).

Next, as shown in FIG. 25A, when original document G1 is printed in black and altering the color of the area Ga of original document G1, area designation sheet G2 is superimposed on original document G1. Then, as shown in FIG. 25B, the area of area designation sheet G2 corresponding to the area Ga is surrounded with red coloring area Gb as shown by the slanting lines (ST1). That is, the color alteration area is surrounded on area designation sheet G2.

Next, the operator aligns area designation sheet G2 with fixed scale $2_2$ on original table 2 (ST2) and presses "AREA READ" key 30c (ST3). When this is done, first carriage $41_1$ is moved in the direction away from fixed scale $2_1$ while photosensitive drum 10, etc, remain stopped, and exposure scanning of area designation sheet G2 which is placed at the side of fixed scale $2_2$ is carried out. Along with this scanning, the reflected light from area designation sheet G2 is transmitted by lens 173 to CCDs **174*a* and 174*b* via color filters 172*a* and 172*b* respectively. The photoelectric conversion output signals of CCDs 174*a* and 174 are respectively supplied to A/D converters 182*a* and 182*b* via amplifiers 181*a* and 181*b* shown in FIG. 24 and are converted into digital signals. Each of these converted signals is stored in memory 184 via DMA 183 (ST4). When scanning is completed by first carriage $41_1$, the color discrimination process can be carried out by two types of image information data stored in memory 184. That is, addition and subtraction is carried out between the two types of information stored in memory 184, red is discriminated and position data for the red-surrounded areaa Gb is stored in memory 184** (ST5).

Then, the red-surrounded area Gb, in other words the color alteration area, is judged based on the stored position data for the red-surrounded area Gb, and erasure data for the color alteration area and erasure data for parts other than the color alteration area is generated and stored in two memory areas in memory 140 (ST16). That is, in one of the memory areas, high-level signals are stored at the addresses corresponding to the area in which red-surrounded area Gb and low-level signals are stored at the other addresses while, in the other memory area, low-level signals are stored at the addresses corresponding to the area of red-surrounded area Gb and high-level signals are stored at the other addresses.

Next, the operator lines up original document G1 on setting scale $2_1$ of original table 2 (ST17), and presses copy key $30_1$ (ST18). When this is done, copying action will be carried out on parts other than the area Ga of original document G1 using developing unit $12_1$, in which black toner is stored, and erasure array 150. That is, first carriage $41_1$ is moved and exposure scanning is carried out on original document G1.

In conjunction with this, erasure data are supplied to array driver 160 from one memory area of memory 140. Erasure array 150 is operated in response to this erasure data and the electrostatic charge corresponding to red-surrounded surrounded area Gb is erased from photosensitive drum 10. Consequently, when remain electrostatic image is developed and developed image is transferred on to paper P, as shown in FIG. 25C, only the area other than the color alteration area in original document G1 which was designated on area designation sheet G2 are copied on paper P (ST19).

After this, paper P on which this copy has been made is sent back to the image transferring section by multicopying unit 28 (ST20). Next, using developing unit $12_1$ in which red toner is stored and erasure array 150, copying action is carried out on the area Ga of original document G1. That is, first carriage $41_1$ is moved and exposure scanning of original document G1 is carried out.

Figure 25D:
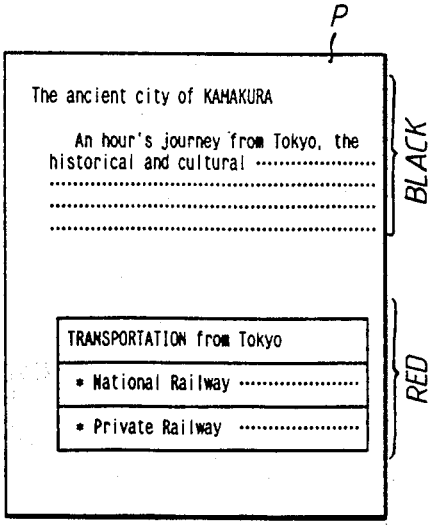

In conjunction with this, erasure data are supplied to array driver 160 from the other memory area of memory 140. Erasure array 150 is operated in response to this erasure data and the electrostatic charge corresponding to the area other than red-surrounded section Gb is erased from photosensitive drum 10. Consequently, when this image is developed and developed image is transferred on to paper P, as shown in FIG. 25D, of original document G1, only the sections of the color alteration area which are designated by area designation sheet G2 are copied on to paper P. Thus, an image is formed on paper P in which the area Ga of original document G1 is colored in red. Then paper P is sent to tray 25 via fixing rollers 21, discharge rollers 24 (ST21, 22). As a result, as shown in FIG. 25D, paper P is obtained on which an image of the area Ga of original document G1 is formed in red and an image of the area other than the area Ga of original document G1 is formed is black.

In the above mentioned embodiment, although the designation of the above trimming area, masking area and color alteration area were for one place only, the same operation can be carried out even for more than one designated area.

The above embodiment is designed so that the trimming area, masking area and color alteration area to be copied are designated with different respective colors on an original other than the original document. Trimming, masking and color alteration is judged by these colors and these designated areas are discriminated by a reader unit and stored in a memory. The image of the designated area is erased from the image of the original document and the original document is then copied, or the color of the image in the designated area is changed and it is then copied, by suitably controlling array driver 160, erasure array 150 and multicopy unit 28 in response to the discrimination information. Consequently, since erasure or color alteration of a required area of an original image is possible by a comparatively simple construction and, moreover, without requiring special key operation, when editing original images, this invention is very useful.

A third embodiment of the present invention will be described hereinafter. If no description is given, the constitution of the second embodiment is the same as that of the first and second embodiments.

Figure 28:
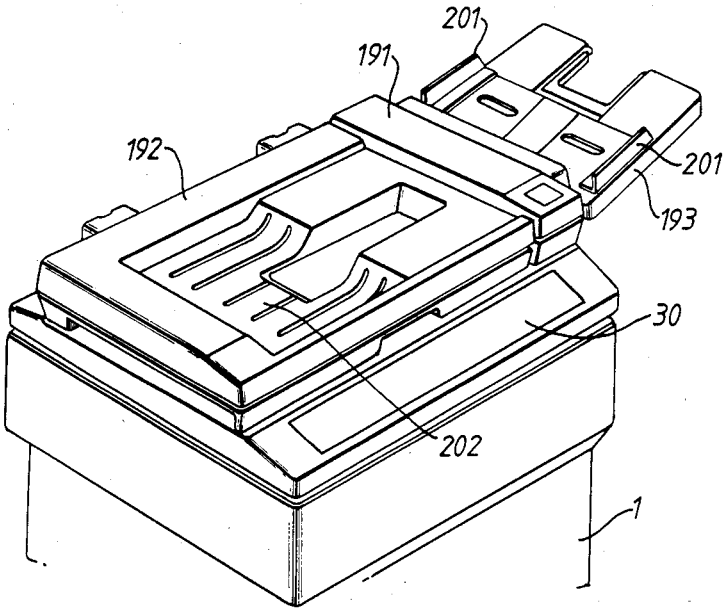
Figure 29:
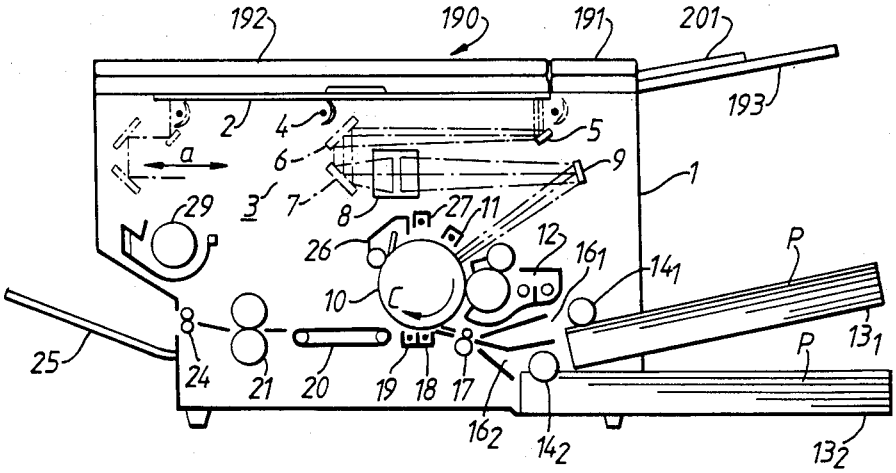

FIGS. 28 and 29 schematically show a copying machine as an image forming apparatus having the automatic document feeder of this invention. Reference number 1 denotes a copying machine housing. An automatic document feeder 60 which supplies original documents automatically is mounted on top of housing 1.

Figure 30:
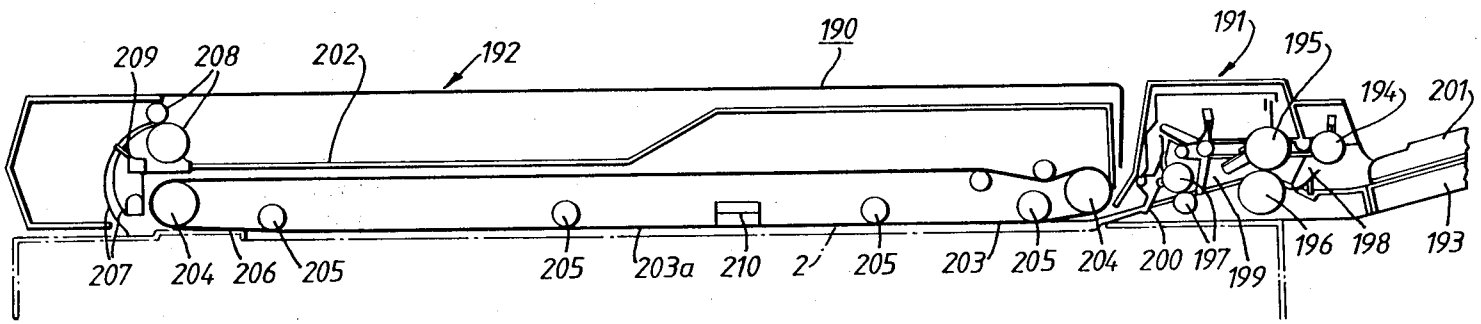

Referring to FIGS. 28, 29 and 30, automatic document feeder 190 comprises a supply section 191 which supplies original documents and a transport section 192 for transport of original documents. Supply section 191 consists of a document supply tray 193 on which documents are set, a supply roller 194 for effecting supply of original documents that have been set on supply tray 193, a forwarding roller 195, a separating roller 196 and a pair of aligning rollers 197. A detector 198 which detects when there are no original documents on document supply tray 193 is provided near forwarding roller 195, a detector 199 for detecting original document supply faults is provided between forwarding roller 195 and aligning rollers 197, and a detector 200 which detects the size of documents that have been supplied in is provided near aligning rollers 197. Detectors 198, 199 and 200 are constituted by elements such as detection levers and microswitches, for example. On document supply tray 63, guides 201 are provided to adjust the width of guides 201 corresponding to the width of documents inserted to supply section 191.

Transport section 192 consists of a document carrier 202 where the discharged original documents are depositing, and an endless belt 203 constituting a transport means for transport of original documents that have been supplied from supply section 191. Transport section 192 further consists of rollers 204 around which endless belt 203 is passed, rollers 205 which press endless belt 203 onto original table 2, a stopper 206 constituting a document stopping means by which the original document that has been fed onto original table 2 is temporarily stopped and held, a guide plate 207 by which the document that has been carried to the end of belt 203 is guided upwards and a pair of feed-out out rollers 208 by which the document led up by guides plate 207 is fed out onto document carrier 202.

A transport path **203*a* is defined by belt 203 and original table 2. Near feed-out rollers 208 there is a detector 209 which detects faults in the transport of the original document being fed out. Detector 209 is constituted by element such as a microswitch, for example. A detector 210 for optical detection of whether transport section 192 is open or closed is provision in transport section 192**.

Figure 32:
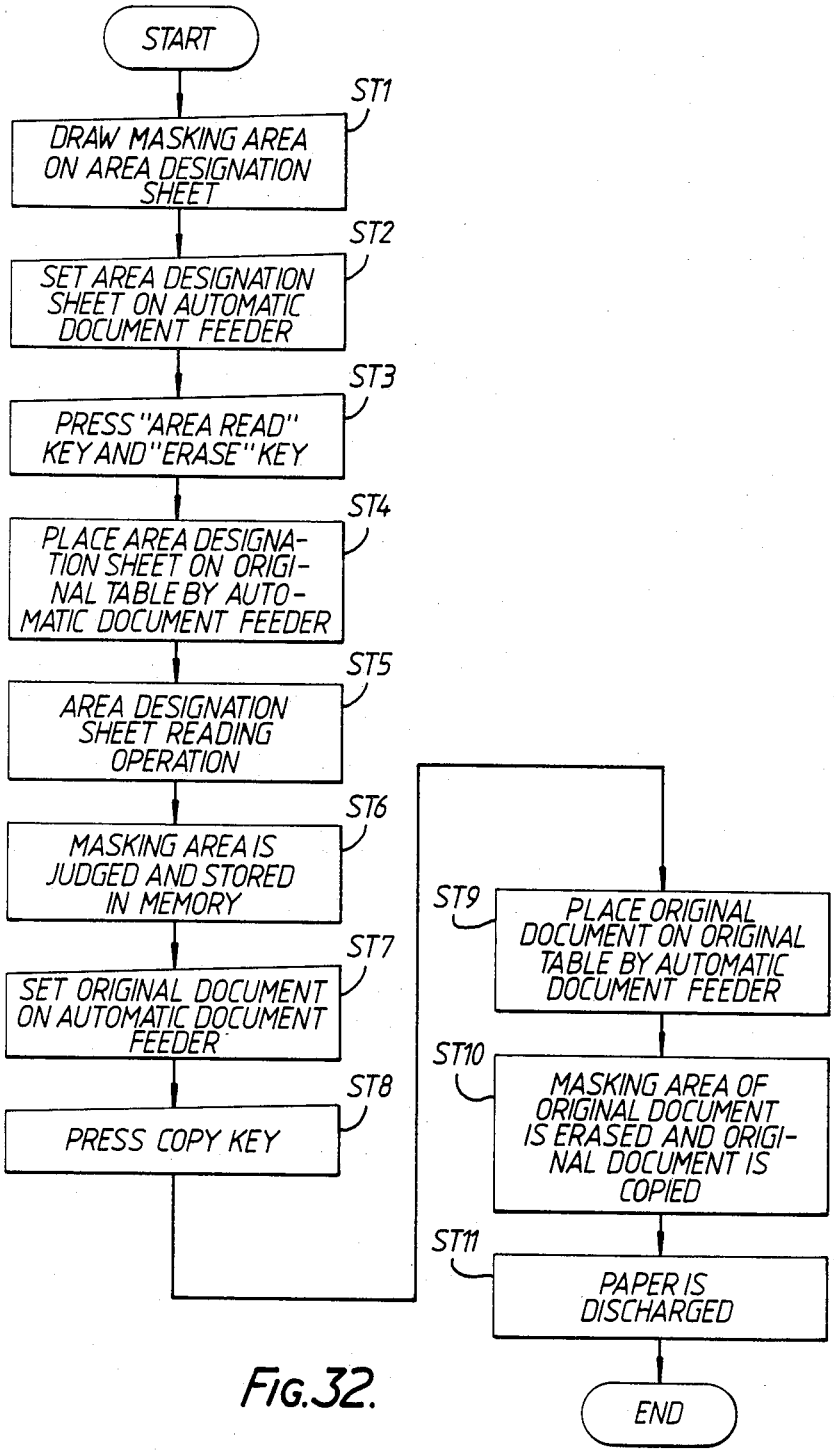

The copying action of this invention for the above construction is explained below referring the flow chart shown in FIG. 32.

Figure 31A:
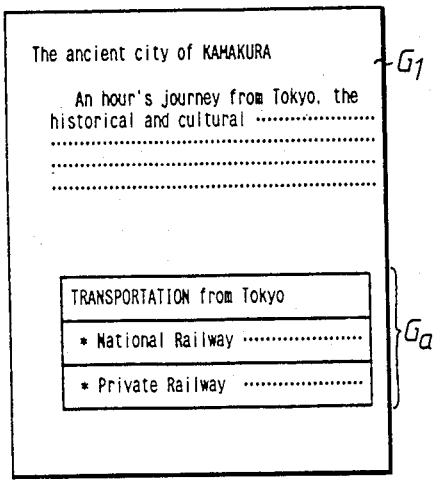
Figure 31B:
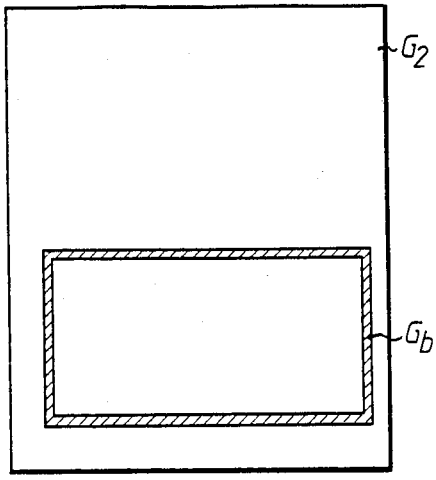

First, as shown in FIG. 31A, when original document G1 is printed in black and the area Ga of original document G1 is masked (erased), area designation sheet G2 is superimposed on original document G1 and, as shown in FIG. 31B, the area of area designation sheet G2 corresponding to the area Ga is surrounded with blue coloring the area Gb as shown by the slanting lines (ST1). That is, the masking area is drawn on area designation sheet G2.

Next, the operator sets the document feed mode by pressing "DOCUMENT FEED" key (replace "COLOR CHANGE" key **30*d* of the first embodiment), places area designation sheet G2 on document supply tray 193 (ST2) and presses "AREA READ" key 30*c* and "ERASE" key 30*a* (ST3). When this is done, area designation sheet G2 is fed to original table 2 by automatic document feeder 190 and placed on original table 2 (ST4). Then, main processor group 101 moves first carriage $41_1$ in the direction away from fixed scale $2_1$ while photosensitive drum 10, etc, remain stopped, and carries out exposure scanning of area designation sheet G2. Along with this scanning, the reflected light from area designation sheet G2 is transmitted by lens 173 to CCD 174. The photoelectric conversion output signals of CCD 174 are supplied to A/D converter 182 via amplifier 181 shown in FIG. 7 and are converted into digital signals. These converted signals are stored in memory 184 via DMA 183 (ST5). Then, the blue-surrounded area Gb, in other words the erasure area, is judged based on the position data for the blue-surrounded area Gb and erasure data for this erasure area is generated and stored in memory 140** (see FIG. 7). That is, high-level signals are stored at the addresses corresponding to the area of blue-surrounded area Gb and low-level signals are stored at the other addresses (ST6).

Next, the operator places original document G1 on document supply tray 193 (ST7), and presses copy key $30_1$ (ST8). When this is done, original document G1 is received by automatic document feeder 190 and placed on original table 2 (ST9). Then, main processor group 71 carries out copying action on the black section of original document G1 using developer 12, in which black toner is stored, and erasure array 150. That is, first carriage $41_1$ is moved and exposure scanning is carried out on original document G1.

Figure 31C:
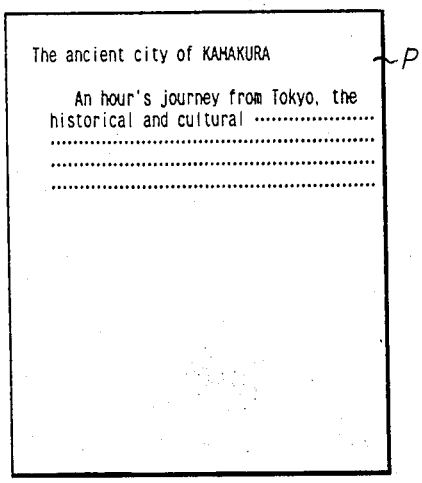

In conjunction with this, erasure data are supplied to array drive section 160 from memory 140. Erasure array 150 is operated in response to this erasure data and the electrostatic charge on photosensitive drum 10 corresponding to the blue-surrounded area Gb is erased. Consequently, when remain electrostatic latent image is developed and developed image is transferred on to paper P, as shown in FIG. 31C (ST10). Paper P on which the erasure area in original document G1 designated by area designation sheet G2 not copied is sent to tray 25 via fixing rollers 21, discharge rollers 24 (ST11).

Even when "ERASE" key **30*b* is pressed instead of "ERASE" key 30*a***, it operates in the same way as above so that an image of the original document in which the image outside the area designated by the area designation sheet has been erased is copied on paper P.

The above the third embodiment is designed so that the erasure area of the original document to be copied is designated on an area designation sheet, other than the original document to be copied, which is placed on the original table first by an automatic document feeder. This designated erasure area is discriminated by a reader unit and stored in a memory. Next, the image of the designated area is erased from the image of the original document which is placed on the original table by the document feeder and the original document is then copied by suitably controlling array driver 160 and erasure array 150 in response to the discrimination information. Consequently, since erasure of a required area of an original image is possible by a comparatively simple construction, when editing original images, this invention is very useful.

What is claimed as new and desired to be secured by Letters Patent of the United States is:

1. An image forming apparatus, wherein an electrostatic latent image is formed on an image carrier by a process of electrostatic charge and image exposure and a reproduced image is formed on said image carrier corresponding to the electrostatic latent image, comprising:

original holding means for holding an original document and an area designation sheet, said area designation sheet including means for defining a surrounded area to designate a copy required area of said original document;

scanning means for optically scanning said area designation sheet placed on said original holding means to obtain a light image of the surrounded area therefrom;

optical reading means for generating electrical signals in responce to the light image of the surrounded area corresponding to the required copy area designated on said area designation sheet;

memory means for storing said electrical signals generated by said optical reading means;

charge erasing means for erasing selected portions of the electrostatic charge on said image carrier; and controlling means for controlling said charge erasing means to erase the electrostatic charge on said image carrier than in the copy required area to be copied, according to the electrical signals read from said memory means.

2. The apparatus according to claim 1, wherein said controlling means includes means for commanding the erasure of the original document's image inside or outside the surrounded area designated on said area designation sheet.

3. The apparatus according to claim 1, wherein said optical reading means includes a Charge Coupled Device (CCD).

4. The apparatus accoarding to claim 3, wherein said optical reading means further includes:

focusing means for focusing a light image of the surrounded area obtained by said scanning means onto said CCD; and color filter means provided between said focusing means and CCD for passing specified light.

5. The apparatus according to claim 1, wherein said defining means includes various coloring of the surrounded area.

6. The apparatus according to claim 5, wherein said controlling means further controlling said charge erasing means to erase the electrostatic charge inside the surrounded area or outside the surrounded area in response to the various coloring of the surrounded area designated on said area designation sheet.

7. The apparatus according to claim 5, wherein said controlling means further controlling said charge erasing means to erase the electrostatic charge inside the surrounded area in responce to a first coloring of the surrounded area and outside the surrounded area in response to a second coloring of the surrounded area.

8. The apparatus according to claim 7, wherein said first coloring is yellow and said second coloring is green.

9. The apparatus according to claim 1, wherein said original holding means includes an original table.

10. The apparatus according to claim 9, wherein said original holding means further includes an automatic document feeder associated with said original table for feeding said original document and area designation sheet onto said original table.

11. The apparatus according to claim 1, wherein said charge erasing means includes a plurality of light-emitting elements which are opposed to said image carrier and arranged in a row.

12. The apparatus according to claim 11, wherein the light-emitting elements of said charge erasing means are arranged at positions so as to radiate said image carrier in the image exposure step.

13. The apparatus according to claim 11, wherein the light-emitting elements of said charge erasing means are arranged at positions so as to radiate said image carrier in the image development step.

* * * * *